US010962922B1

(12) United States Patent
Matsushima

(10) Patent No.: US 10,962,922 B1
(45) Date of Patent: Mar. 30, 2021

(54) IMAGE FORMING APPARATUS THAT PREVENTS A LOAD FROM BEING GENERATED

(71) Applicant: TOSHIBA TEC KABUSHIKI KAISHA, Tokyo (JP)

(72) Inventor: Toshihiro Matsushima, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/785,677

(22) Filed: Feb. 10, 2020

(51) Int. Cl.
*G03G 15/00* (2006.01)
*G03G 21/16* (2006.01)

(52) U.S. Cl.
CPC ..... *G03G 21/1652* (2013.01)

(58) Field of Classification Search
CPC .. G03G 15/80; G03G 15/166; G03G 21/1652; G03G 2221/1636
USPC ..... 399/1–4, 90, 107, 110, 111, 113, 399/116–118
See application file for complete search history.

(56) References Cited

U.S. PATENT DOCUMENTS 6,272,299 B1 * 8/2001 Numagami ..... G03G 21/186 399/111
8,364,059 B2 * 1/2013 Kato ..... G03G 21/1647 399/111
8,571,443 B2 * 10/2013 Kobayashi ..... G03G 21/1633 399/125
8,781,357 B2 * 7/2014 Miwa ..... G03G 21/206 399/111
9,229,397 B2 * 1/2016 Yokoi ..... G03G 15/04054
2020/0238257 A1 7/2020 Yoo

FOREIGN PATENT DOCUMENTS

JP 2007-292902 11/2007
JP 2009-220973 10/2009
JP 2016-175237 10/2016

* cited by examiner

*Primary Examiner* — Hoan H Tran
(74) *Attorney, Agent, or Firm* — Amin, Turocy & Watson LLP

(57) ABSTRACT

According to one embodiment, an image forming apparatus includes an electrically conductive and grounded frame, an image forming unit, a print head, a holder that supports the print head, an electrically conductive urging member between the print head and the holder for urging the print head toward the image forming unit, and an electrically conductive arm extending from the urging member and electrically connected to the urging member. The arm floats when the print head moves away from the image forming unit and is electrically connected to the frame when the print head contacts the image forming unit.

20 Claims, 20 Drawing Sheets

IMAGE FORMING APPARATUS THAT PREVENTS A LOAD FROM BEING GENERATED

FIELD

Embodiments described herein relate generally to an image forming apparatus.

BACKGROUND

In an image forming apparatus such as an electrophotographic apparatus, a technique for exposing a photoconductive drum of an image forming unit by an exposure apparatus having a print head, attaching a developer such as toner to the photoconductive drum, and transferring the developer to a sheet such as paper is known.

When cleaning the print head or replacing the image forming unit, the print head is at a position separated from the image forming unit. When image formation is performed, the print head is in contact with the image forming unit and is at a predetermined position with respect to the image forming unit.

DETAILED DESCRIPTION

Figure 1:
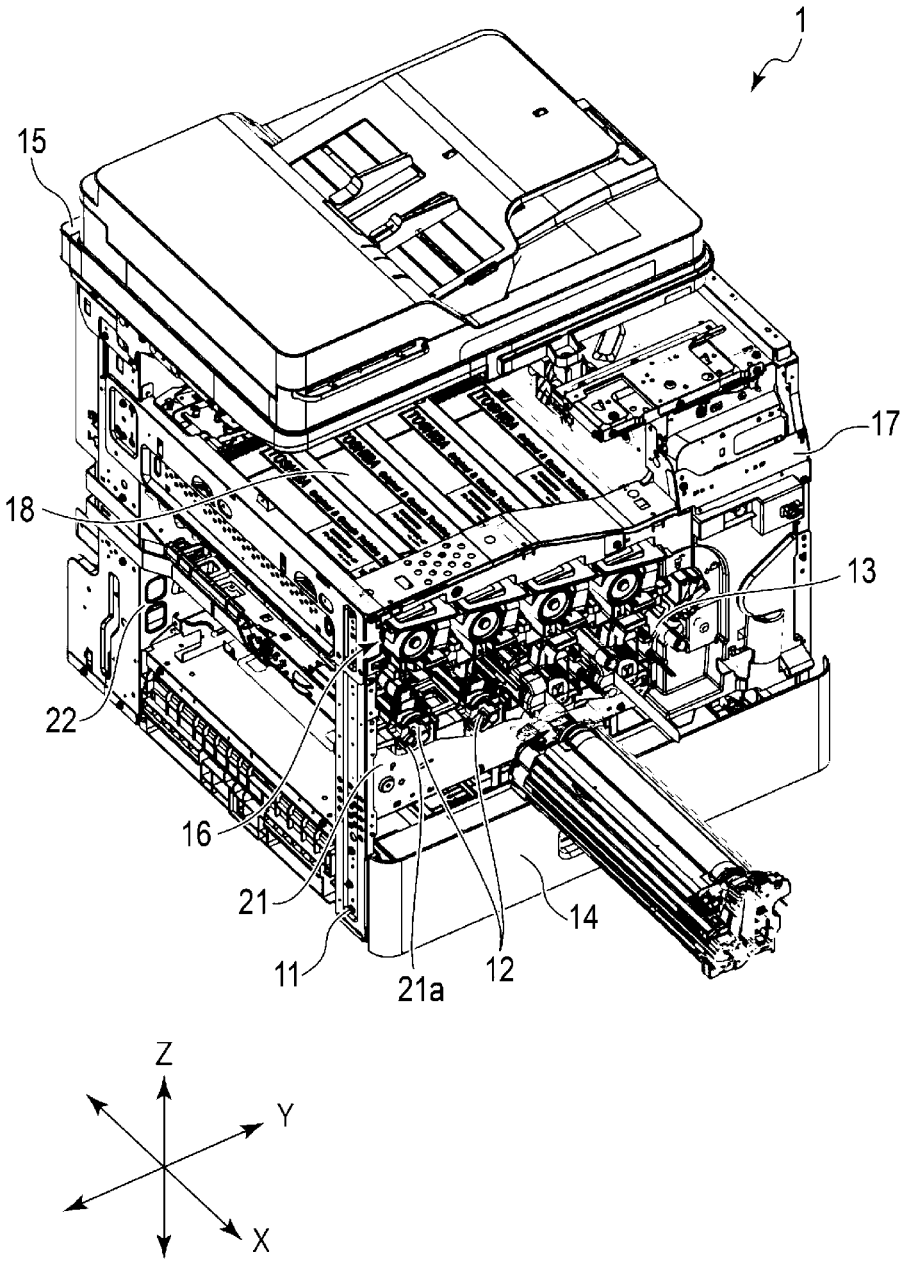
FIG. 1 is a perspective view illustrating an image forming apparatus according to an embodiment.

In general, according to one embodiment, an image forming apparatus according to an aspect includes an electrically conductive and grounded frame, an image forming unit, a print head, a holder that supports the print head, an electrically conductive urging member between the print head and the holder for urging the print head toward the image forming unit, and an electrically conductive arm extending from the urging member and electrically connected to the urging member. The arm floats when the print head moves away from the image forming unit and is electrically connected to the frame when the print head contacts the image forming unit.

An image forming apparatus 1 according to an embodiment will be described with reference to FIGS. 1 to 22.

In the present embodiment, the image forming apparatus 1 will be described below with the direction along the insertion direction of the image forming unit 13 as an X direction, the direction along the gravity direction as a Z direction, and the direction orthogonal to the X direction and the Z direction as a Y direction. The image forming apparatus 1 will be described with the X direction as the front-rear direction and the side on which the image forming unit 13 is inserted or removed as the front. The X direction is also the axial direction of a photoconductive drum 52 when the image forming unit 13 is disposed in a frame 11 and attached to a solid head unit 12.

Figure 2:
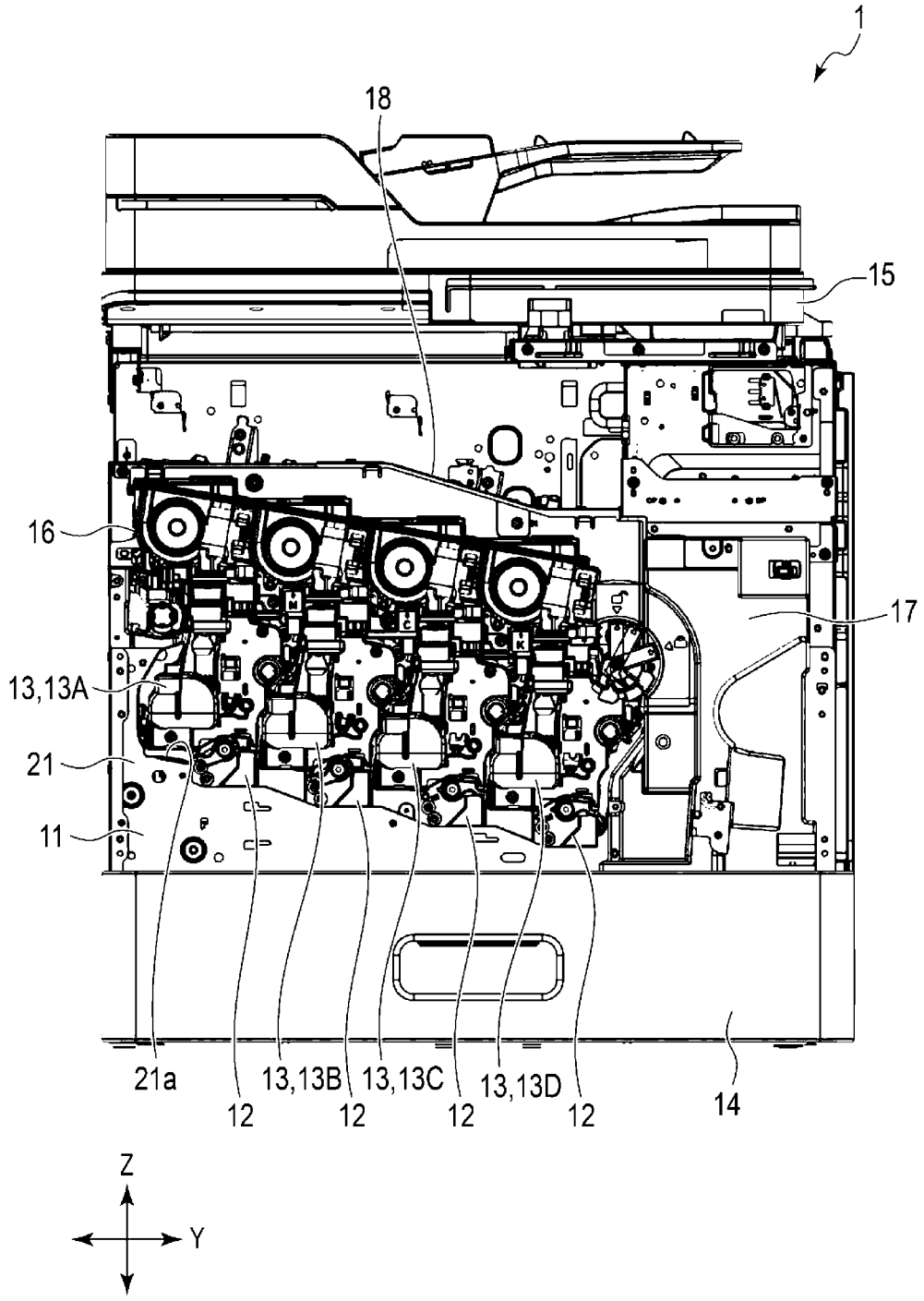
FIG. 2 is a front view illustrating an image forming apparatus according to the embodiment.

FIG. 1 is a perspective view of the image forming apparatus 1. FIG. 2 is a front view of the image forming apparatus 1. In FIGS. 1 and 2, the decorative board of the image forming apparatus 1 is omitted.

Figure 3:
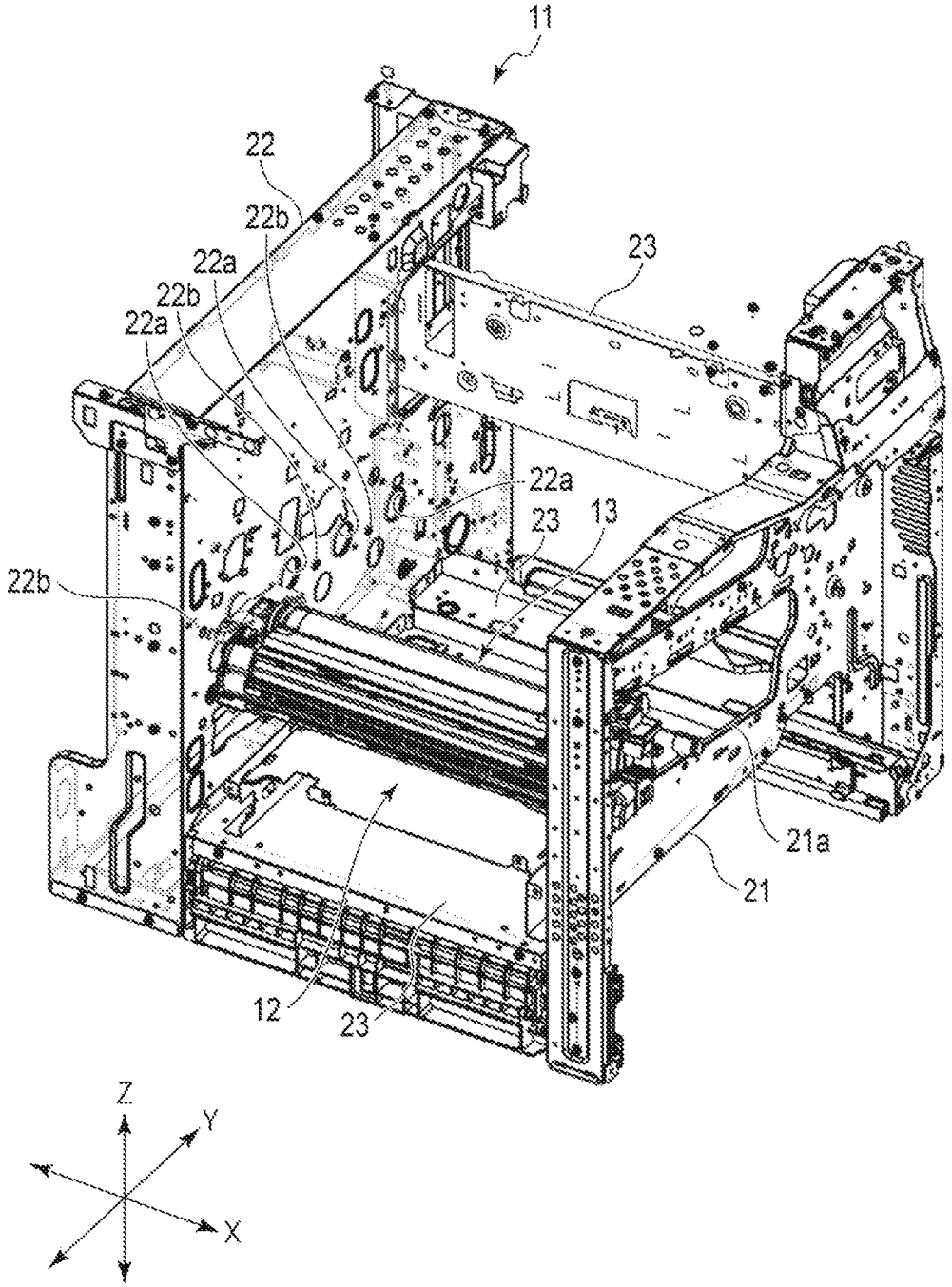
FIG. 3 is a perspective view illustrating a frame, a solid head unit, and an image forming unit of the image forming apparatus according the embodiment.
Figure 4:
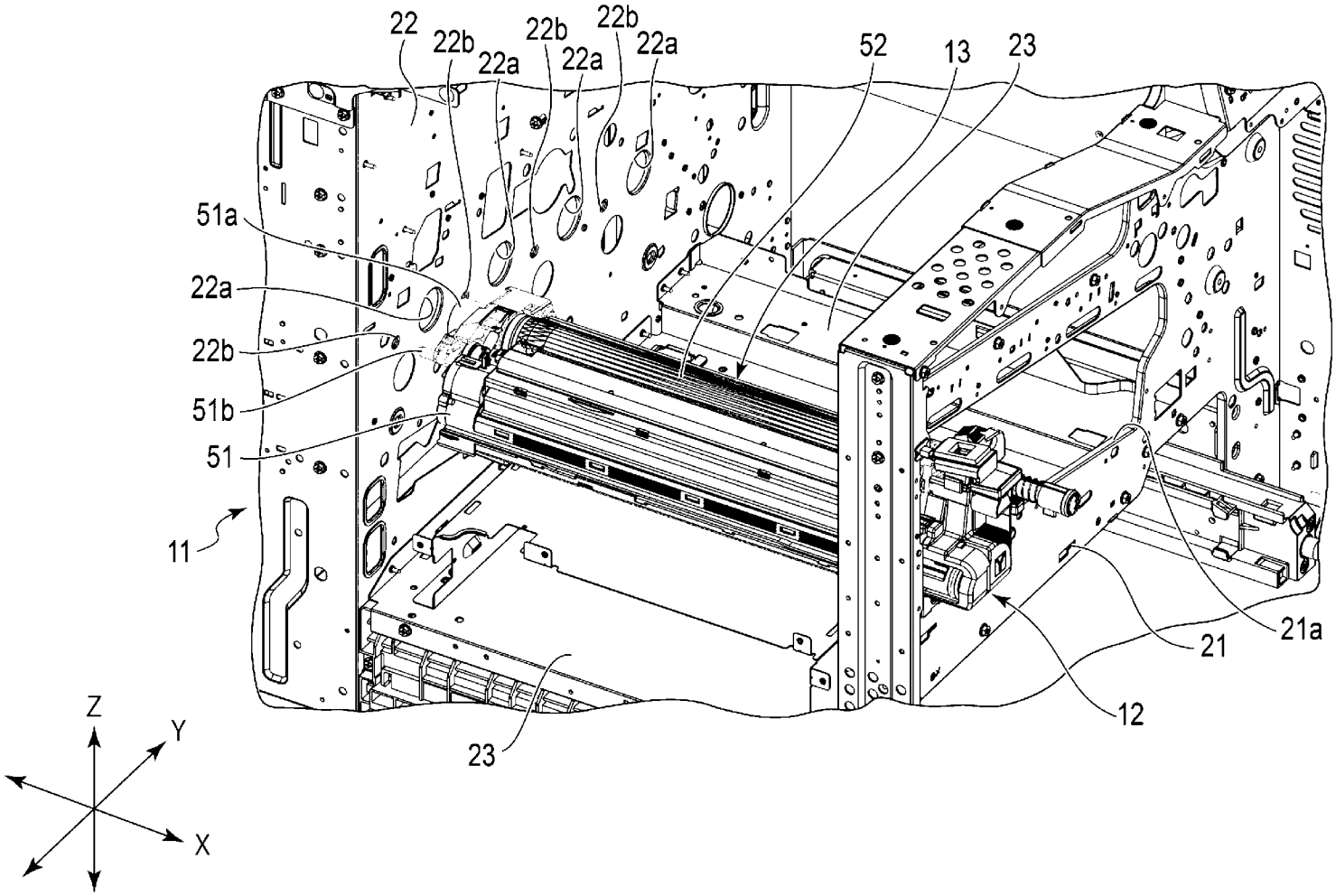
FIG. 4 is a perspective view illustrating main parts of the frame, the solid head unit, and the image forming unit of an image forming apparatus according to the embodiment.

FIGS. 3 and 4 are perspective views illustrating the frame 11, the solid head unit 12, and the image forming unit 13 of the image forming apparatus 1. FIG. 4 illustrates enlarged main parts of the frame 11, the solid head unit 12, and the image forming unit 13. In FIGS. 3 and 4, only one solid head unit 12 and image forming unit 13 are illustrated for convenience of description.

Figure 5:
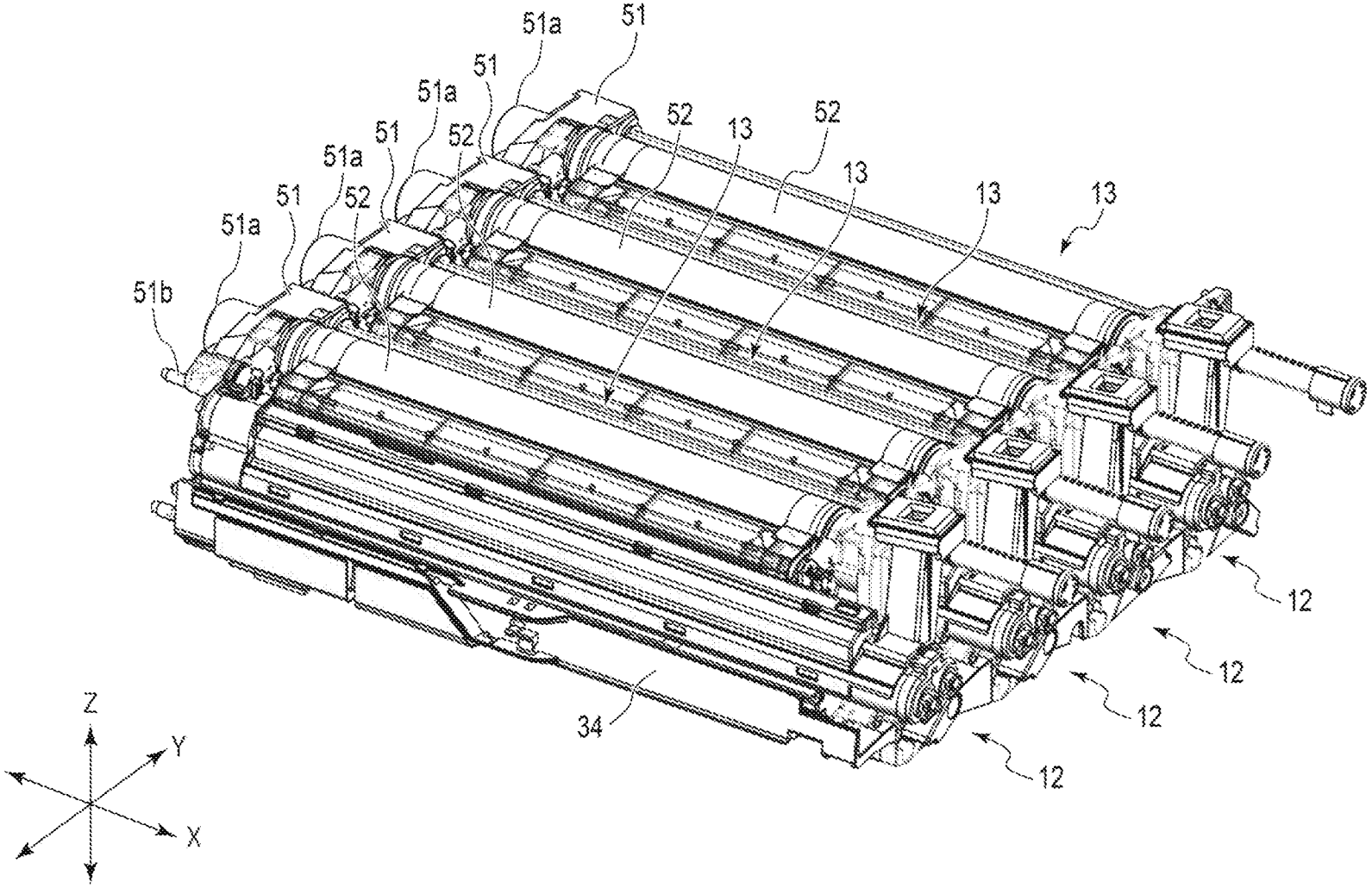
FIG. 5 is a perspective view illustrating the solid head unit and the image forming unit of the image forming apparatus according to the embodiment.

FIG. 5 is a perspective view illustrating four solid head units 12 and four image forming units 13.

Figure 6:
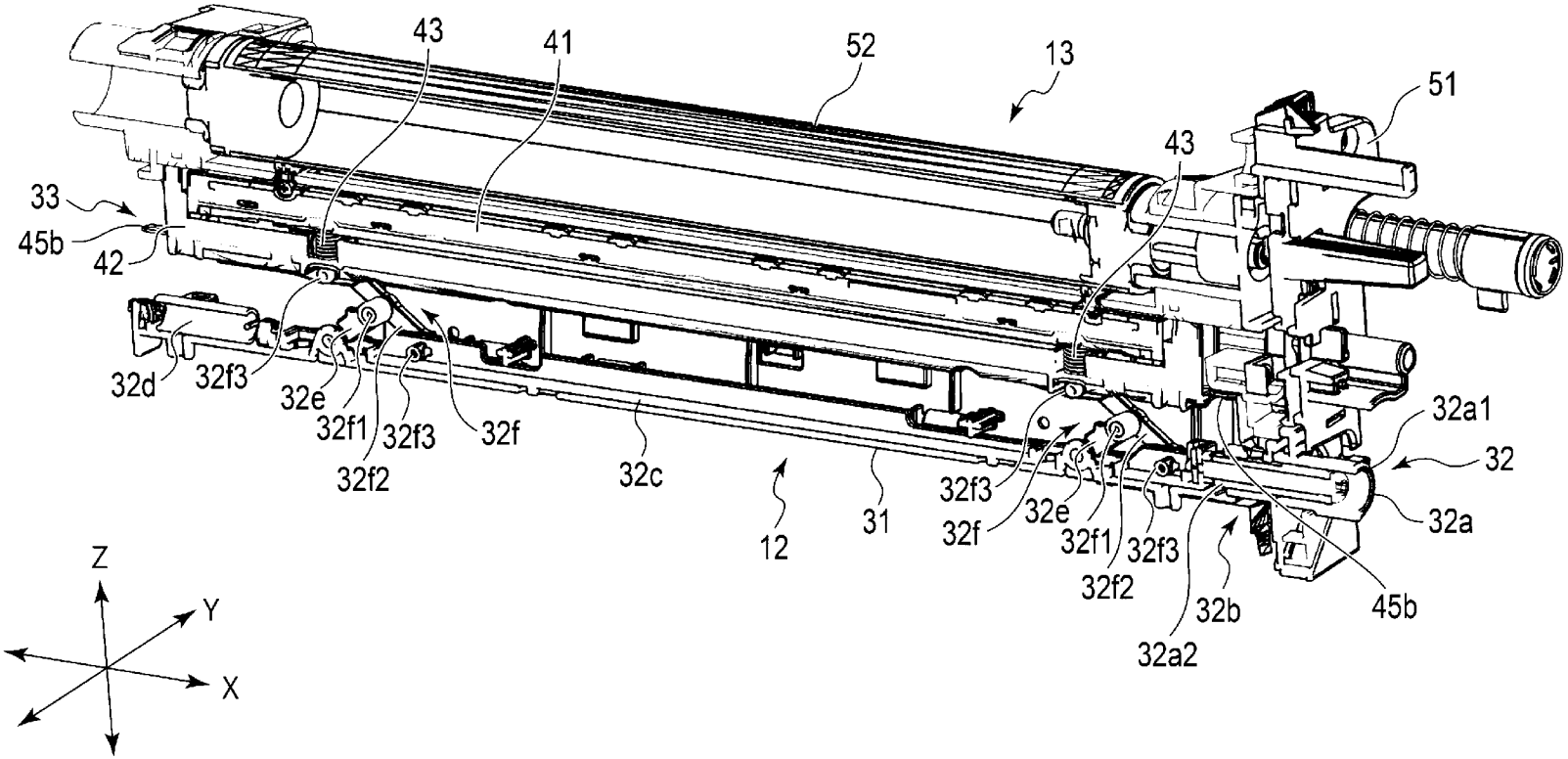
FIG. 6 is a perspective view illustrating the solid head unit and the image forming unit of the image forming apparatus according to the embodiment.
Figure 7:
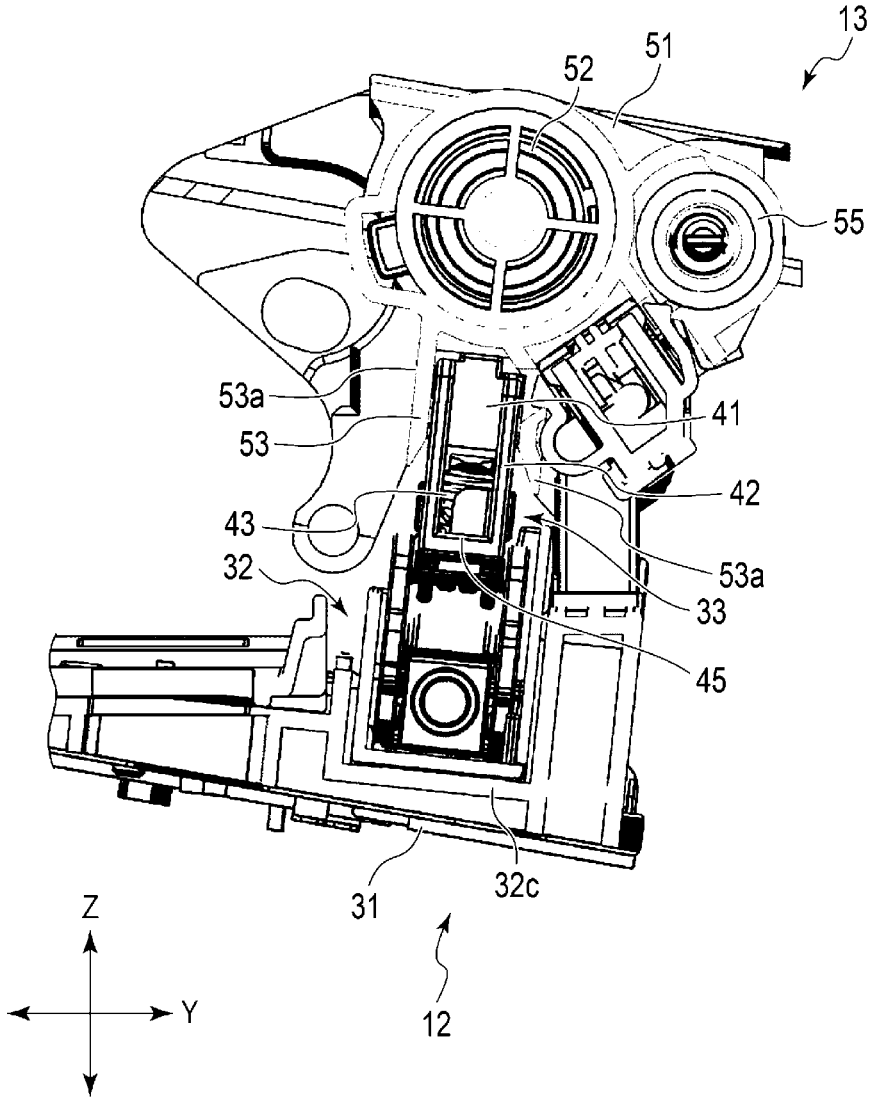
FIG. 7 is a cross-sectional view illustrating the solid head unit and the image forming unit of the image forming apparatus according to the embodiment.

FIGS. 6 and 7 illustrate one solid head unit 12 and one image forming unit 13 in a state where a solid head 33 is in a predetermined position with respect to the image forming unit 13. FIG. 6 is a perspective view. FIG. 7 is a cross-sectional view.

Figure 8:
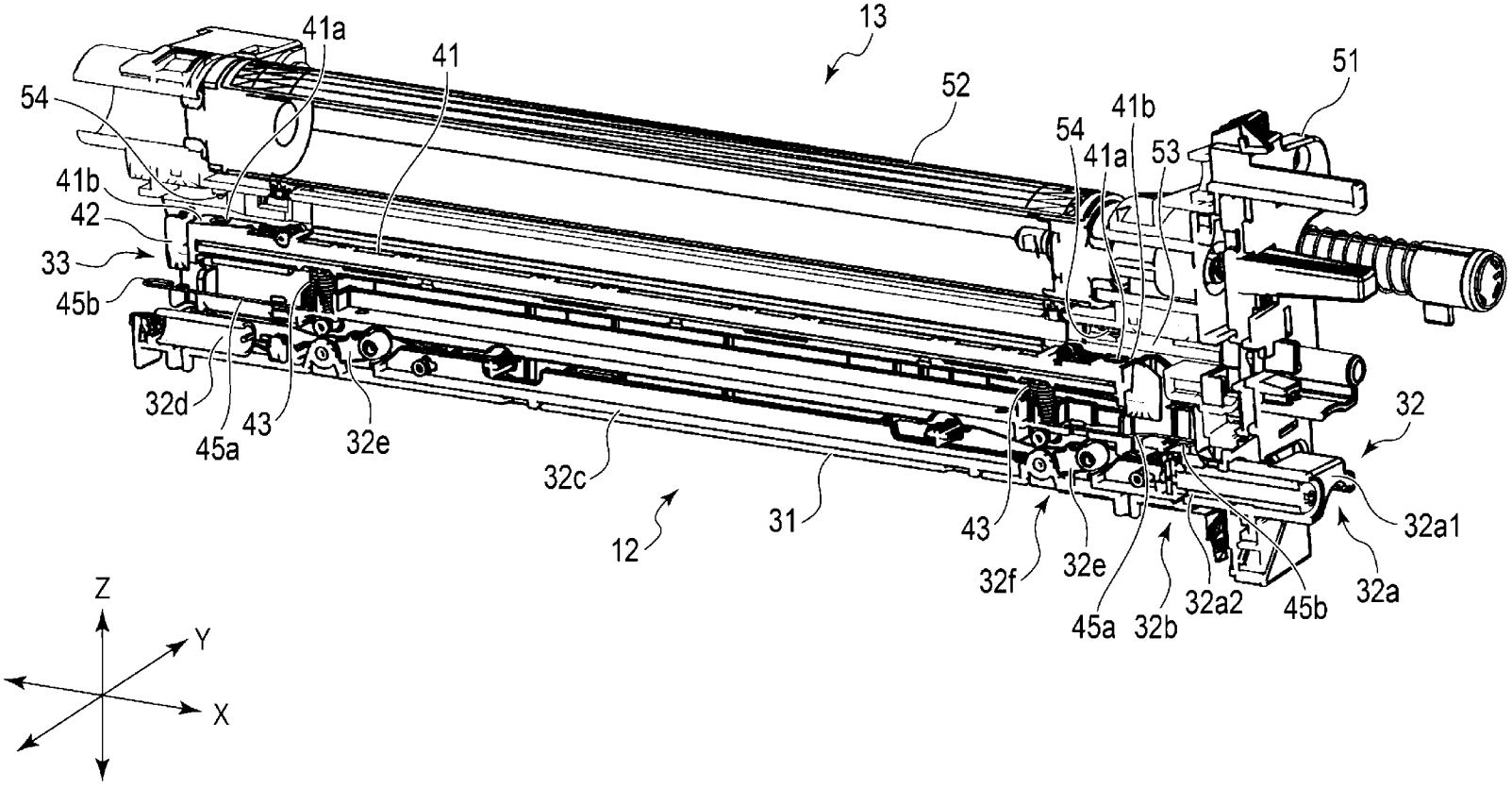
FIG. 8 is a perspective view illustrating the solid head unit and the image forming unit of the image forming apparatus according to the embodiment.
Figure 9:
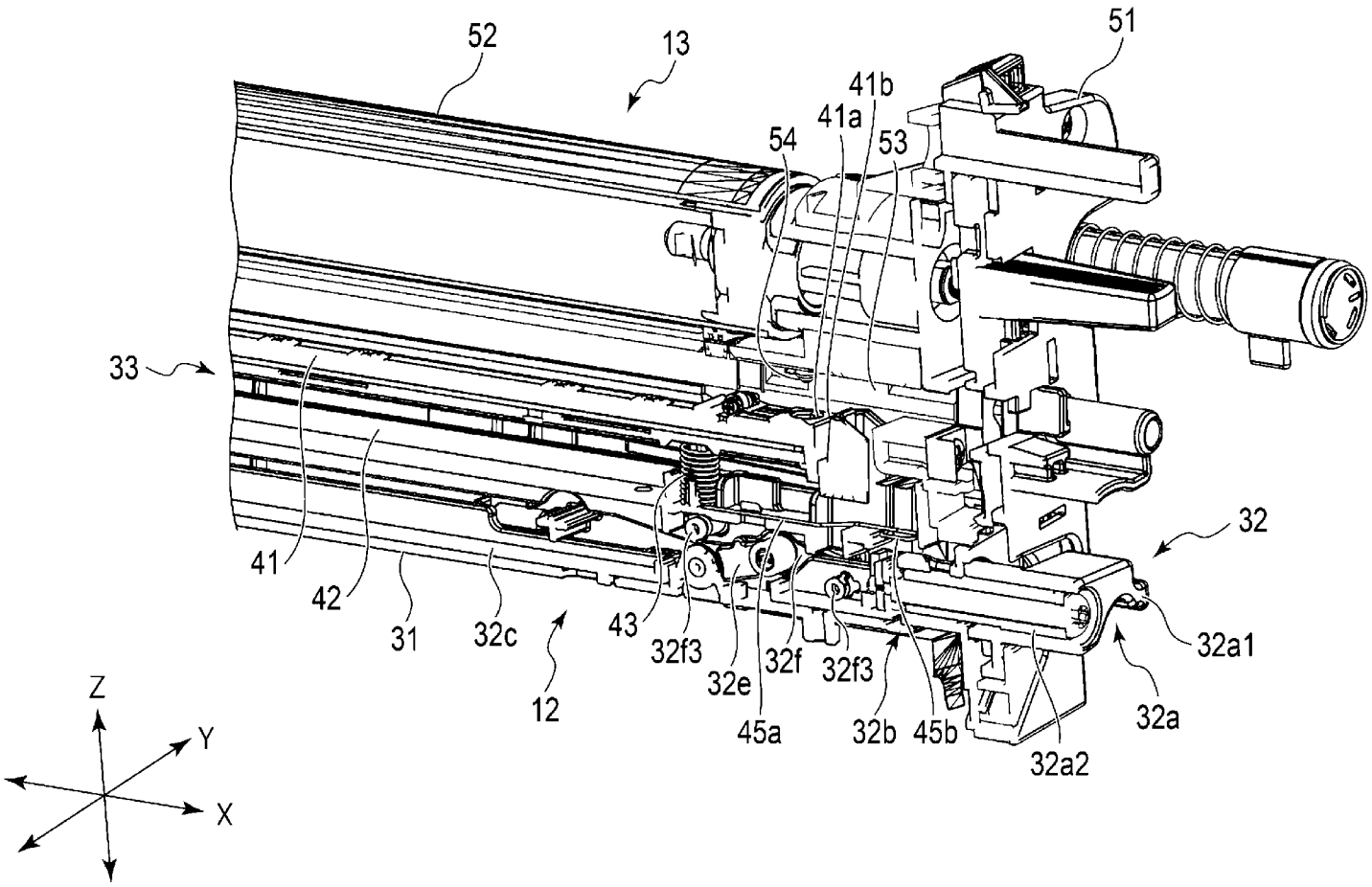
FIG. 9 is a perspective view illustrating the solid head unit and the image forming unit of the image forming apparatus according to the embodiment.
Figure 10:
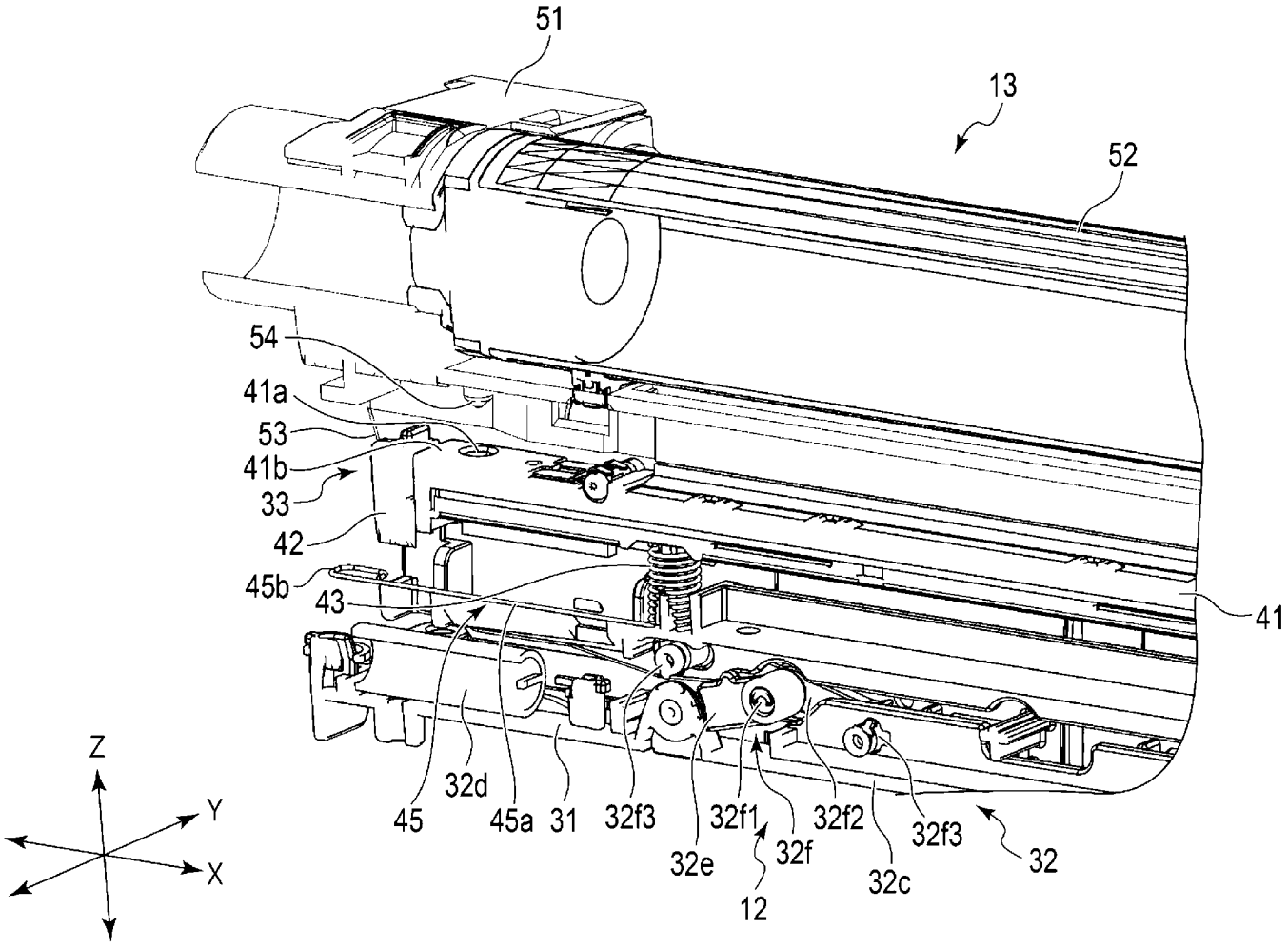
FIG. 10 is a perspective view illustrating the solid head unit and the image forming unit of the image forming apparatus according to the embodiment.
Figure 11:
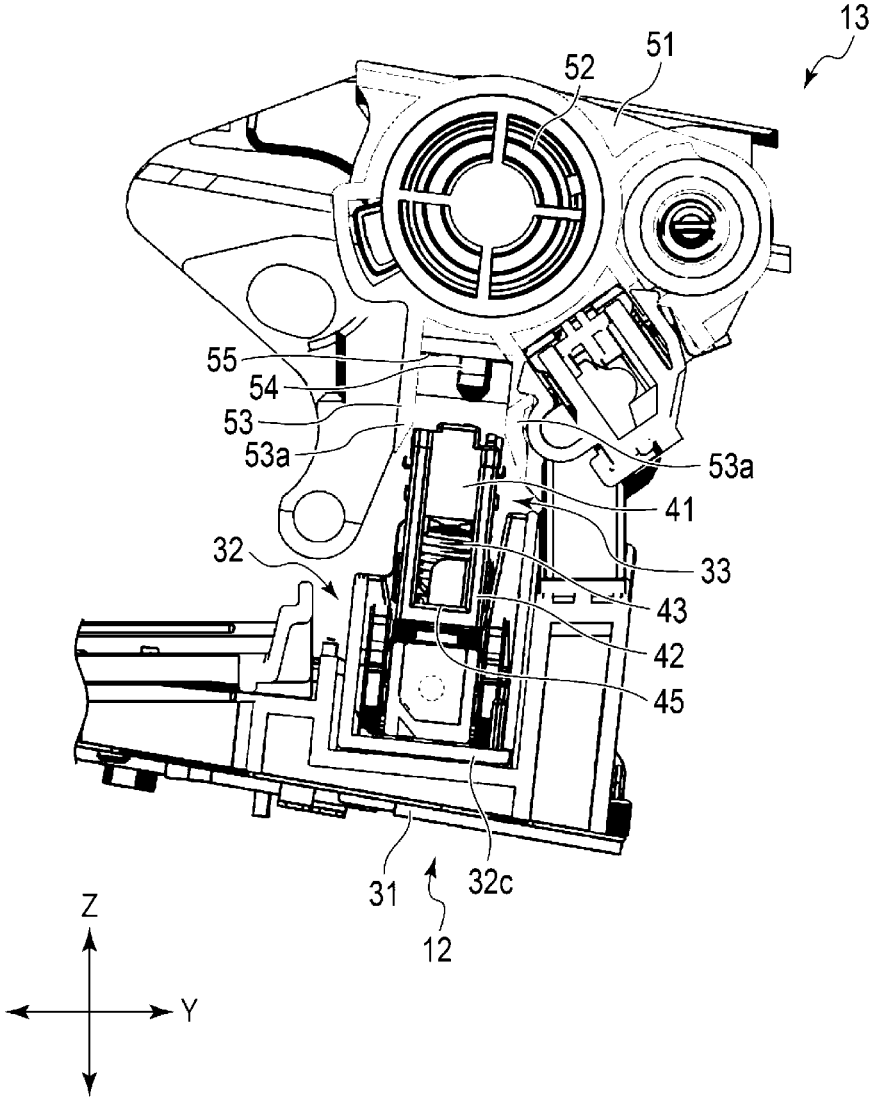
FIG. 11 is a cross-sectional view illustrating the solid head unit and the image forming unit of the image forming apparatus according to the embodiment.

FIGS. 8 to 11 illustrate one solid head unit 12 and one image forming unit 13 in a state where the solid head 33 is located away from the image forming unit 13. FIG. 8 is a perspective view. FIG. 9 is a perspective view illustrating a front frame 21 side of one solid head unit 12 and one image forming unit 13. FIG. 10 is a perspective view illustrating a rear frame 22 side of one solid head unit 12 and one image forming unit 13. FIG. 11 is a cross-sectional view.

Figure 12:
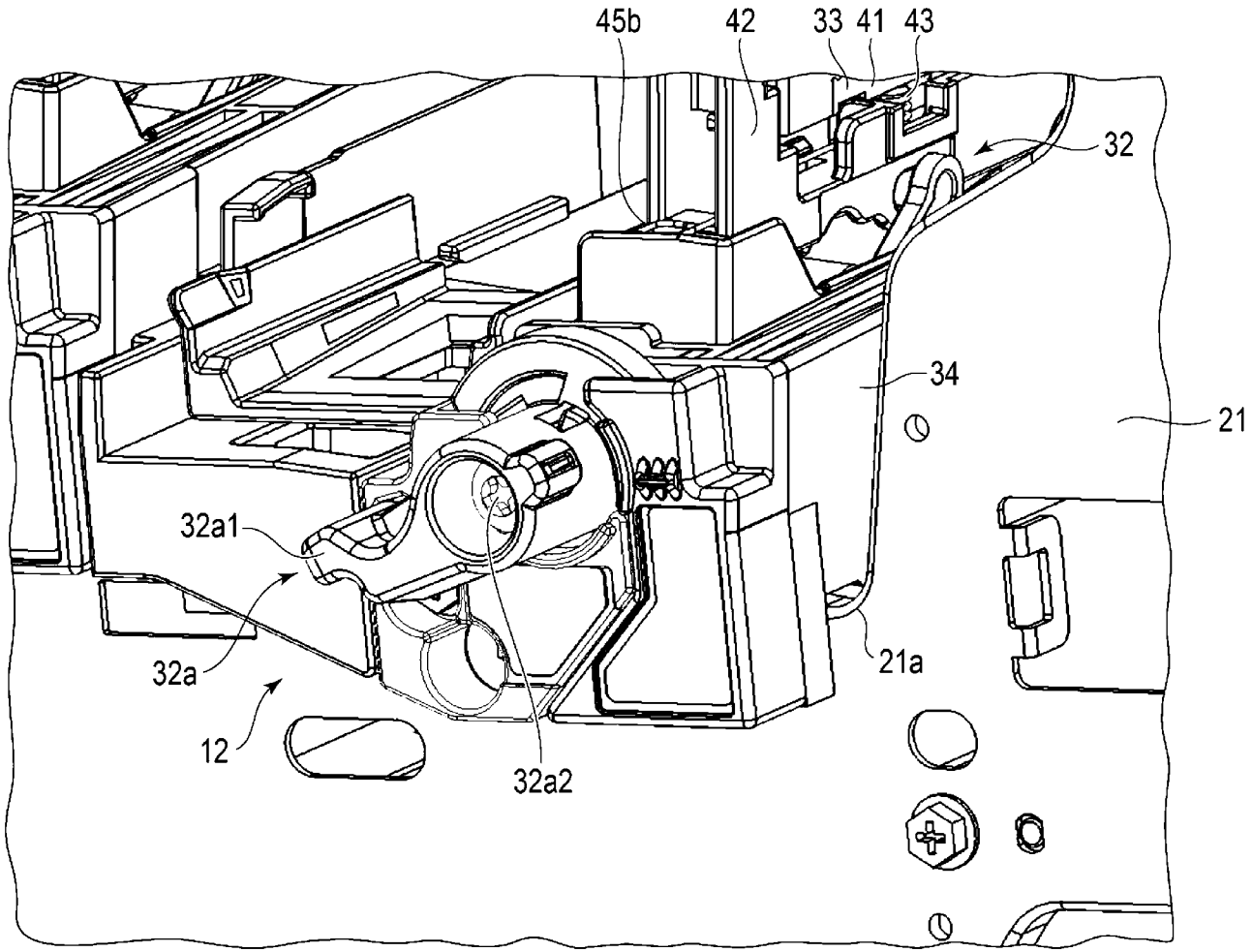
FIG. 12 is a perspective view illustrating the solid head unit of the image forming apparatus according to the embodiment.
Figure 13:
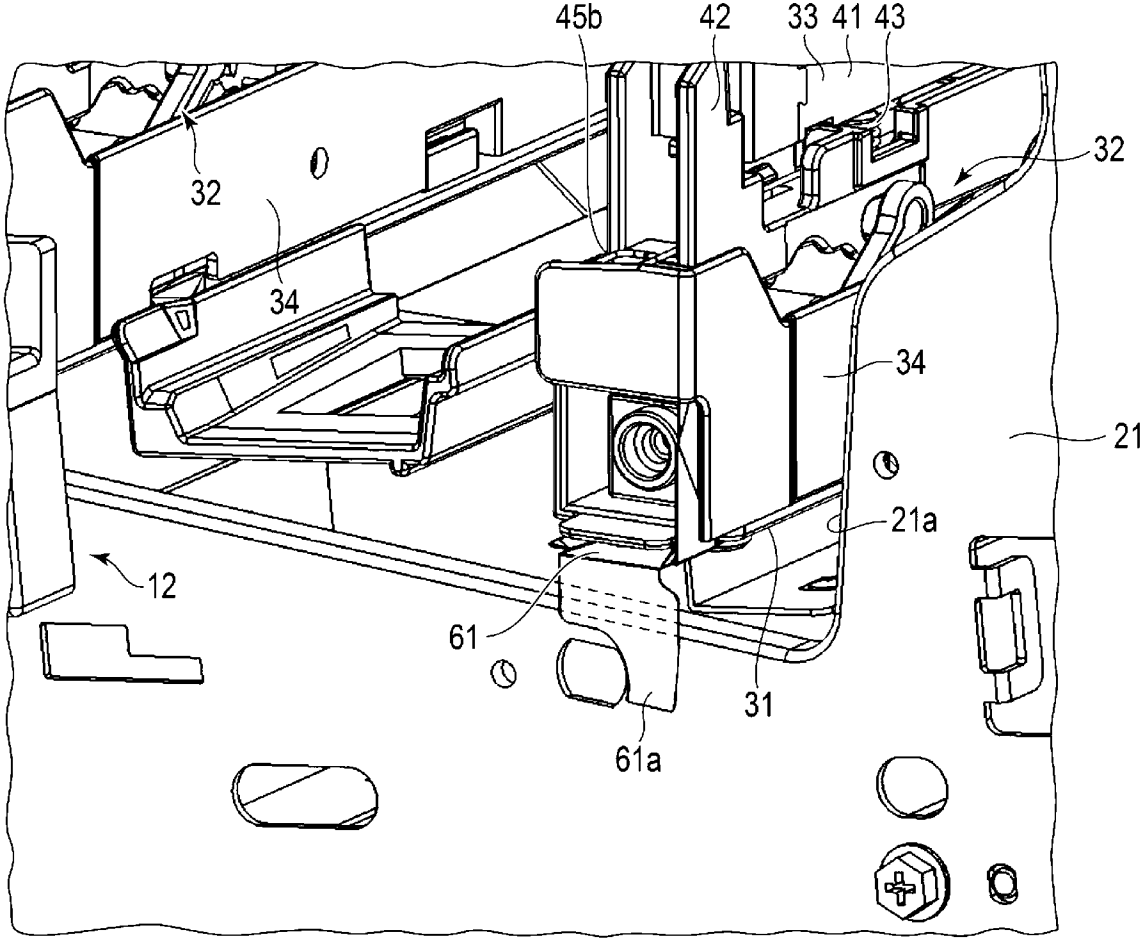
FIG. 13 is a perspective view illustrating the solid head unit of the image forming apparatus according to the embodiment.

FIGS. 12 and 13 are perspective views illustrating the front frame 21 side of one solid head unit 12. FIG. 13 illustrates a state in which an operation lever 32*a* (to be described later) of the solid head unit 12 is omitted and a contact (ground metal plate) 61 is in contact with the front frame 21.

Figure 14:
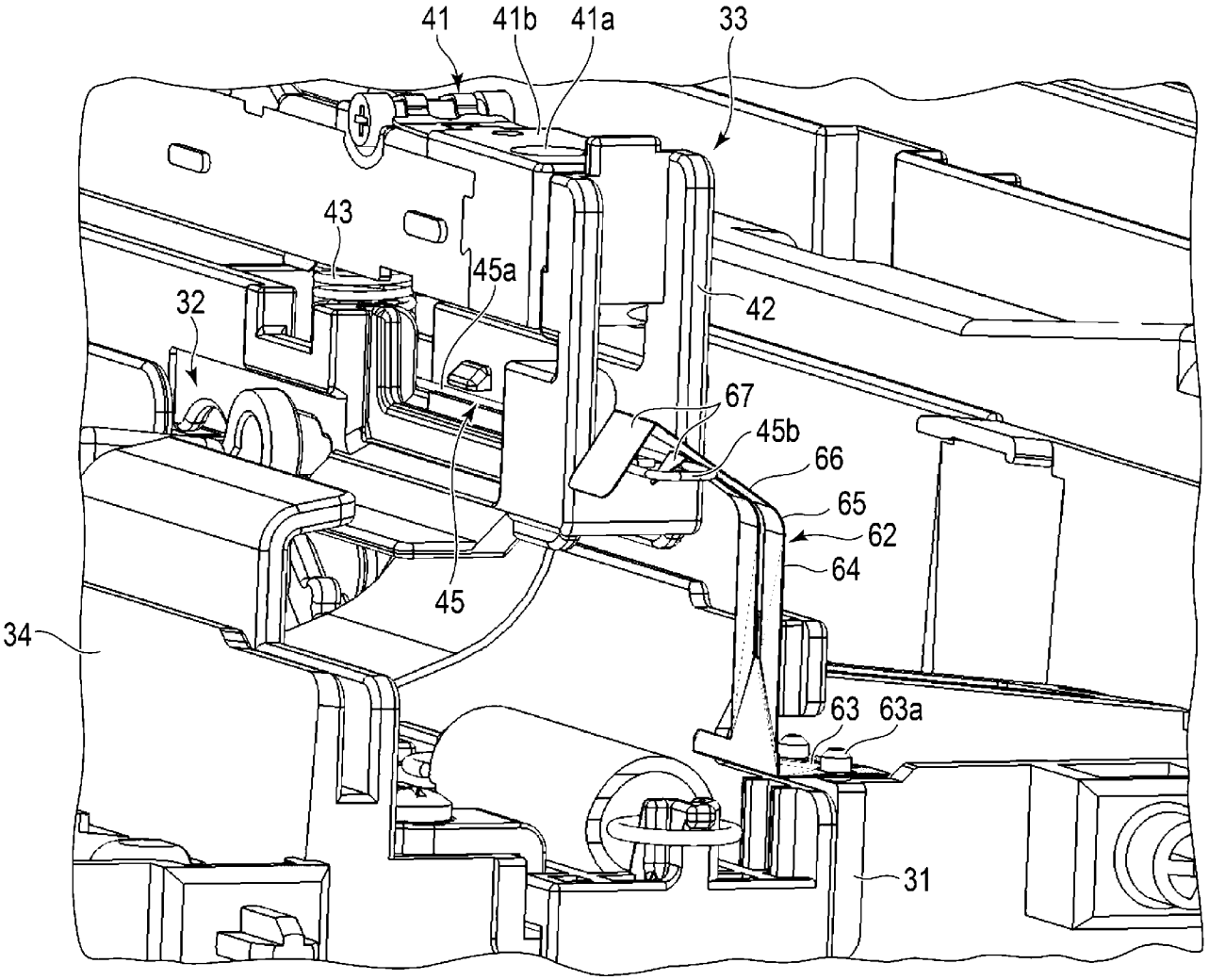
FIG. 14 is a perspective view illustrating the solid head unit of the image forming apparatus according to the embodiment.
Figure 15:
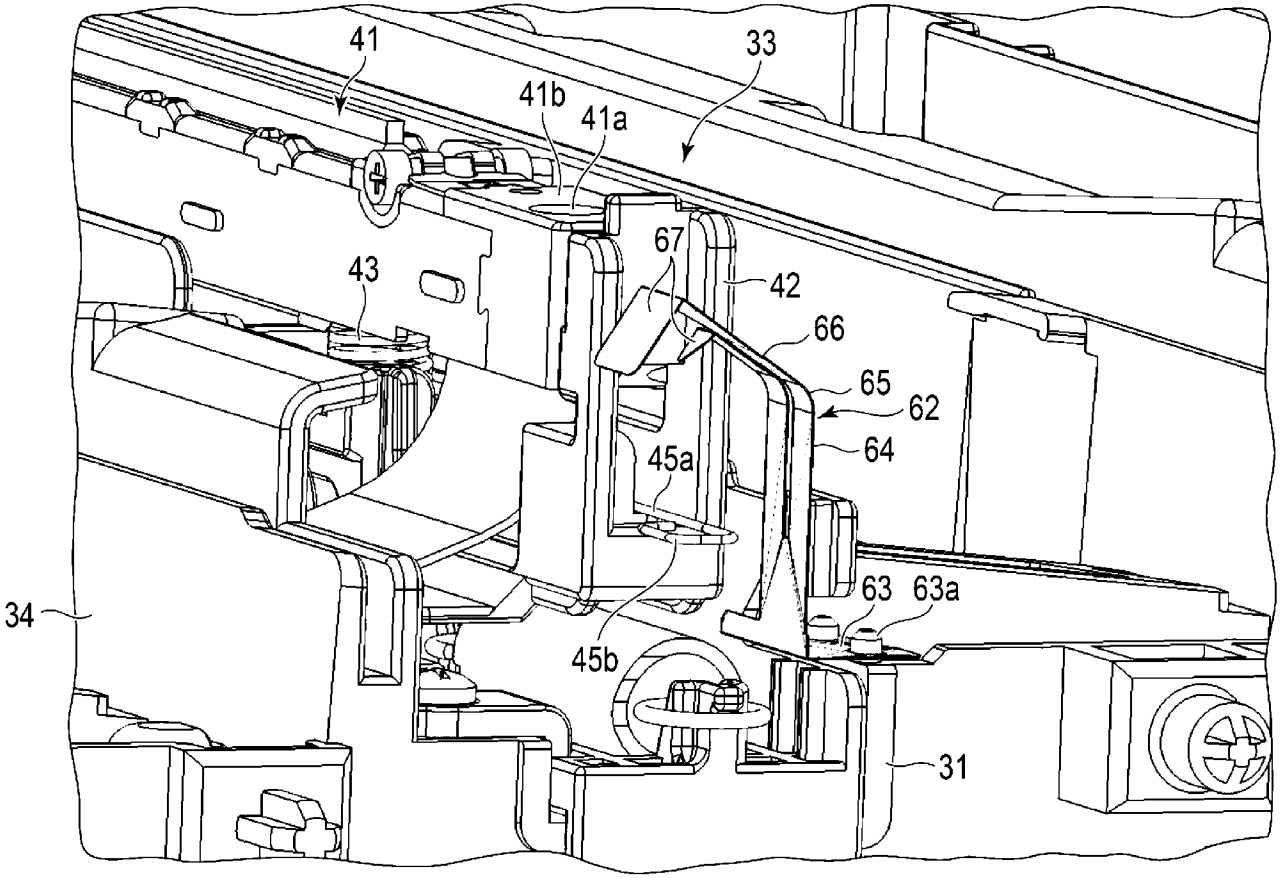
FIG. 15 is a perspective view illustrating the solid head unit of the image forming apparatus according to the embodiment.

FIGS. 14 and 15 are perspective views illustrating the rear frame 22 side of one solid head unit 12. In FIGS. 14 and 15, the illustration of the image forming unit 13 is omitted. FIG. 14 illustrates a state in which the solid head 33 is in a raised position with respect to a base 31. FIG. 15 illustrates a state in which the solid head 33 is in a lowered position with respect to the base 31.

Figure 16:
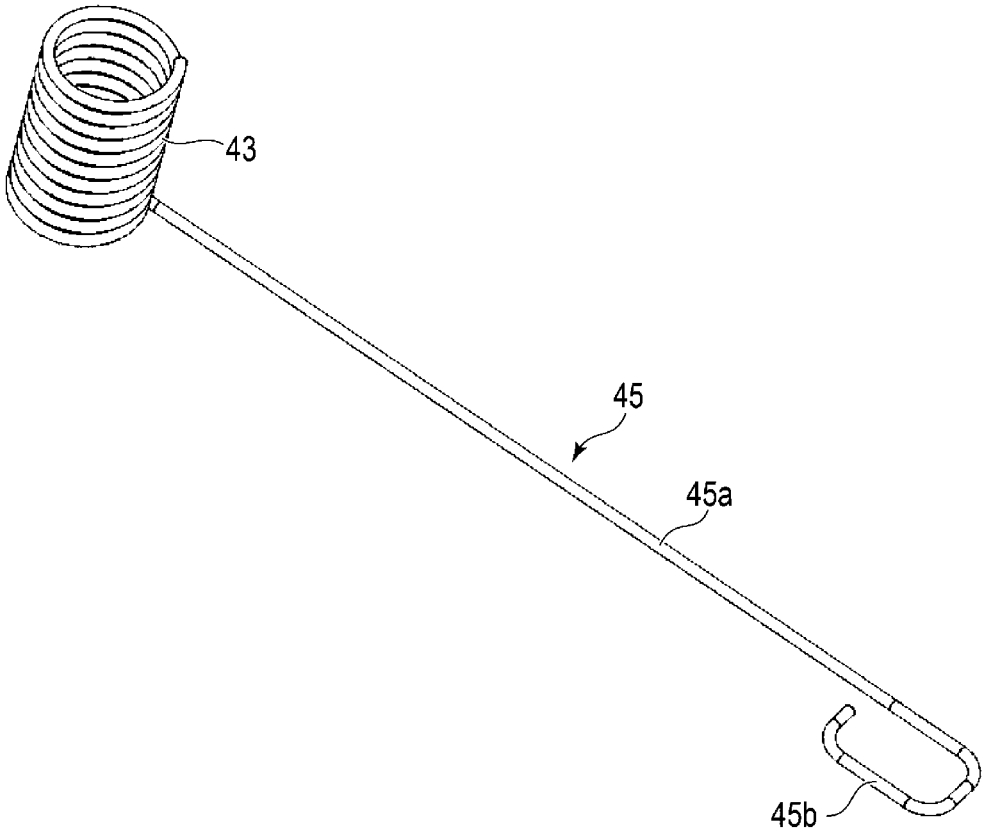
FIG. 16 is a perspective view illustrating an urging member and an arm of the solid head unit of the image forming apparatus according to the embodiment.

FIG. 16 is a perspective view illustrating an urging member 43 and an arm 45 extending from the urging member 43.

Figure 17:
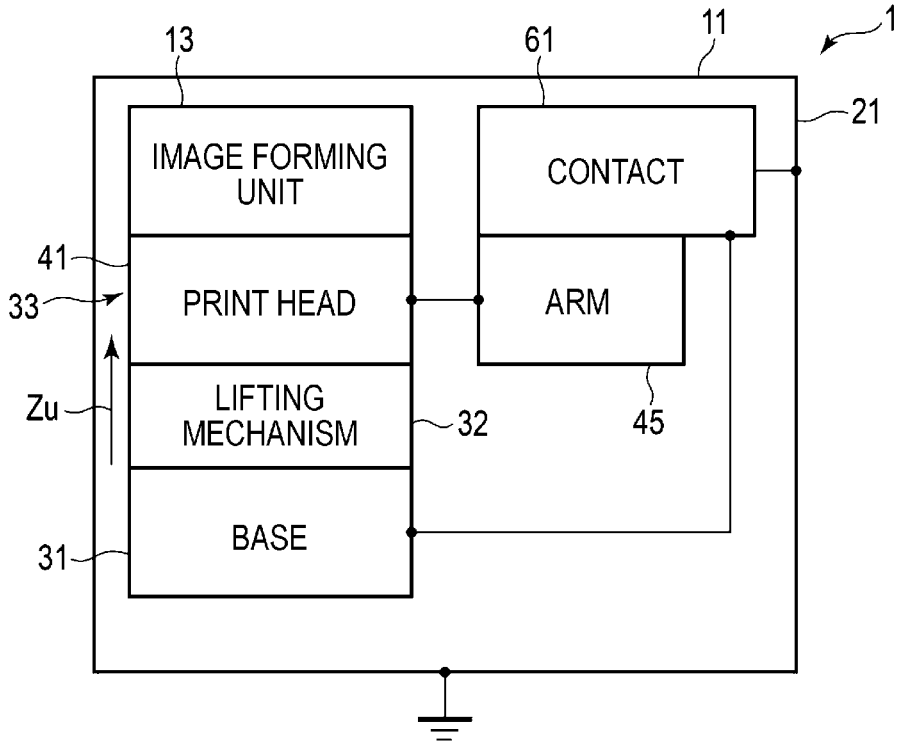
FIG. 17 is a block view illustrating ground connection of the frame (front frame), the solid head unit, and the image forming unit of the image forming apparatus according to the embodiment.
Figure 18:
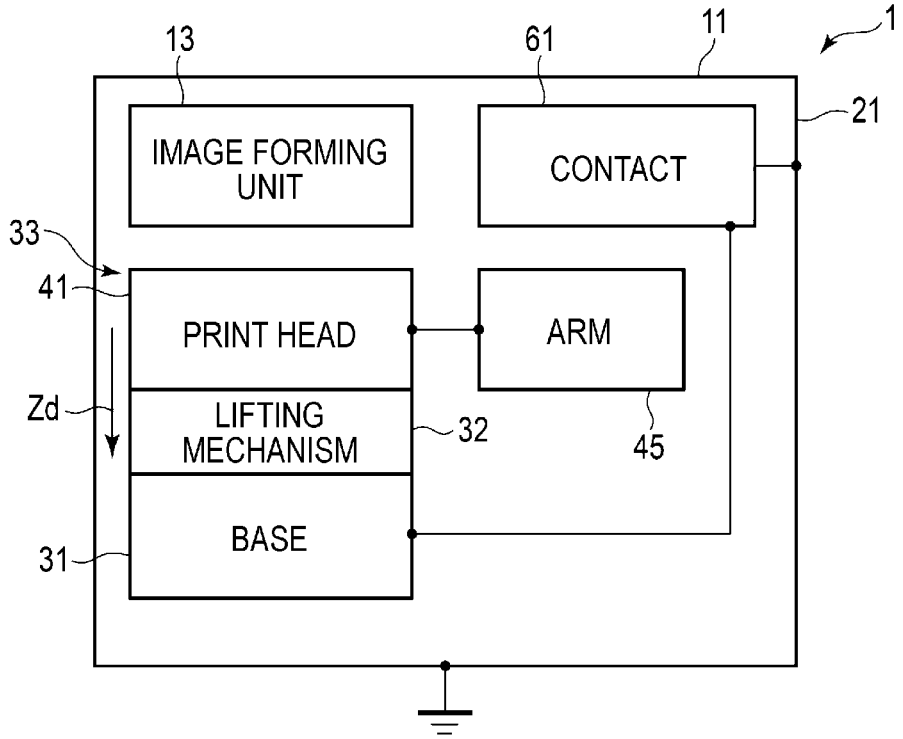
FIG. 18 is a block view illustrating a ground connection of the frame (front frame), the solid head unit, and the image forming unit of the image forming apparatus according to the embodiment.

FIGS. 17 and 18 are block views illustrating a ground connection state of a print head 41 of the solid head 33 with respect to the front frame 21 of the frame 11. FIG. 17 illustrates a state in which the solid head 33 is in a predetermined position with respect to the image forming unit 13. In FIG. 17, the print head 41 of the solid head 33 is electrically connected to the front frame 21. FIG. 18 illustrates a state in which the solid head 33 is at a position separated from the image forming unit 13. In FIG. 18, the print head 41 of the solid head 33 descends with respect to the base 31, and the electrical connection to the front frame 21 is released.

Figure 19:
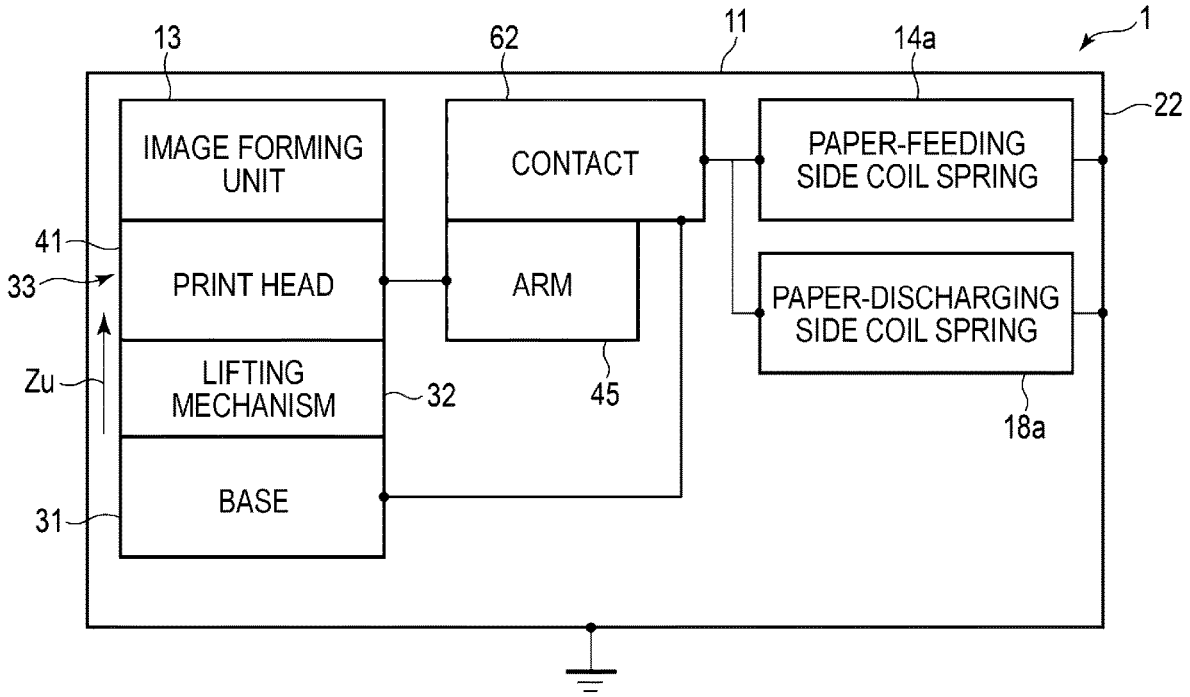
FIG. 19 is a block view illustrating a ground connection of the frame (rear frame), the solid head unit, and the image forming unit of the image forming apparatus according to the embodiment.
Figure 20:
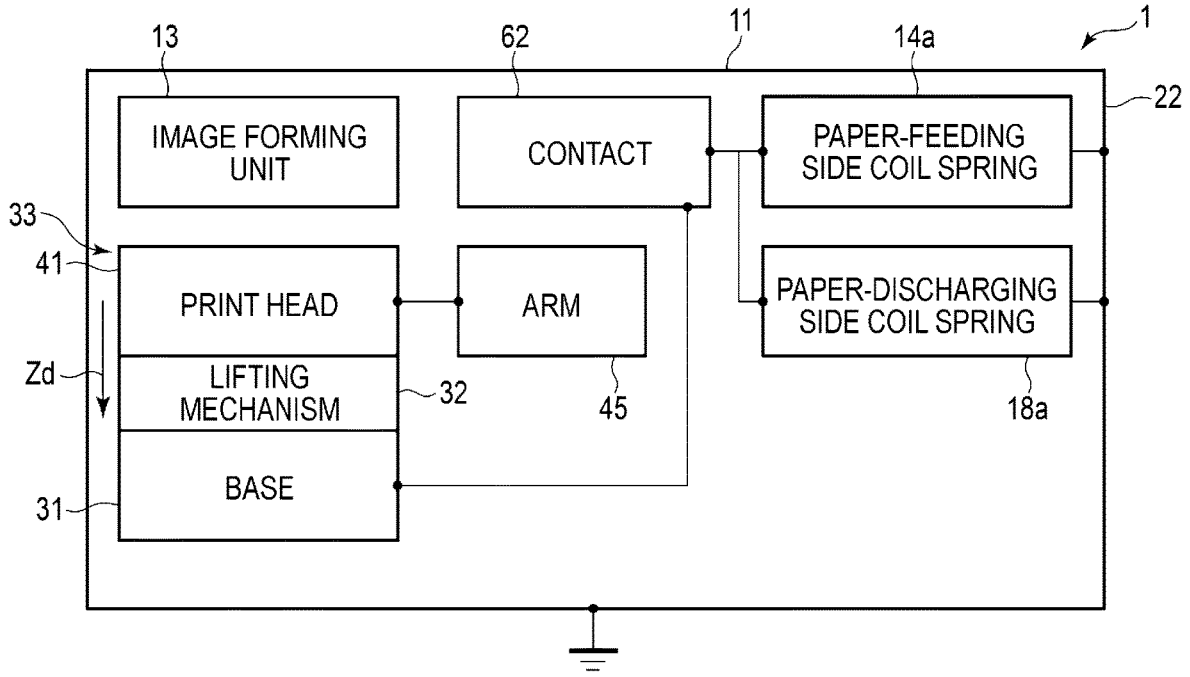
FIG. 20 is a block view illustrating a ground connection of the frame (rear frame), the solid head unit, and the image forming unit of the image forming apparatus according to the embodiment.

FIGS. 19 and 20 are block views illustrating a ground connection state of the print head 41 of the solid head 33 with respect to the rear frame 22 of the frame 11. FIG. 19 illustrates a state in which the solid head 33 is in a predetermined position with respect to the image forming unit 13. In FIG. 19, the print head 41 of the solid head 33 is electrically connected to the rear frame 22. FIG. 20 illustrates a state in which the solid head 33 is at a position separated from the image forming unit 13. In FIG. 20, the print head 41 of the solid head 33 descends with respect to the base 31, and the electrical connection to the rear frame 22 is released.

Figure 21:
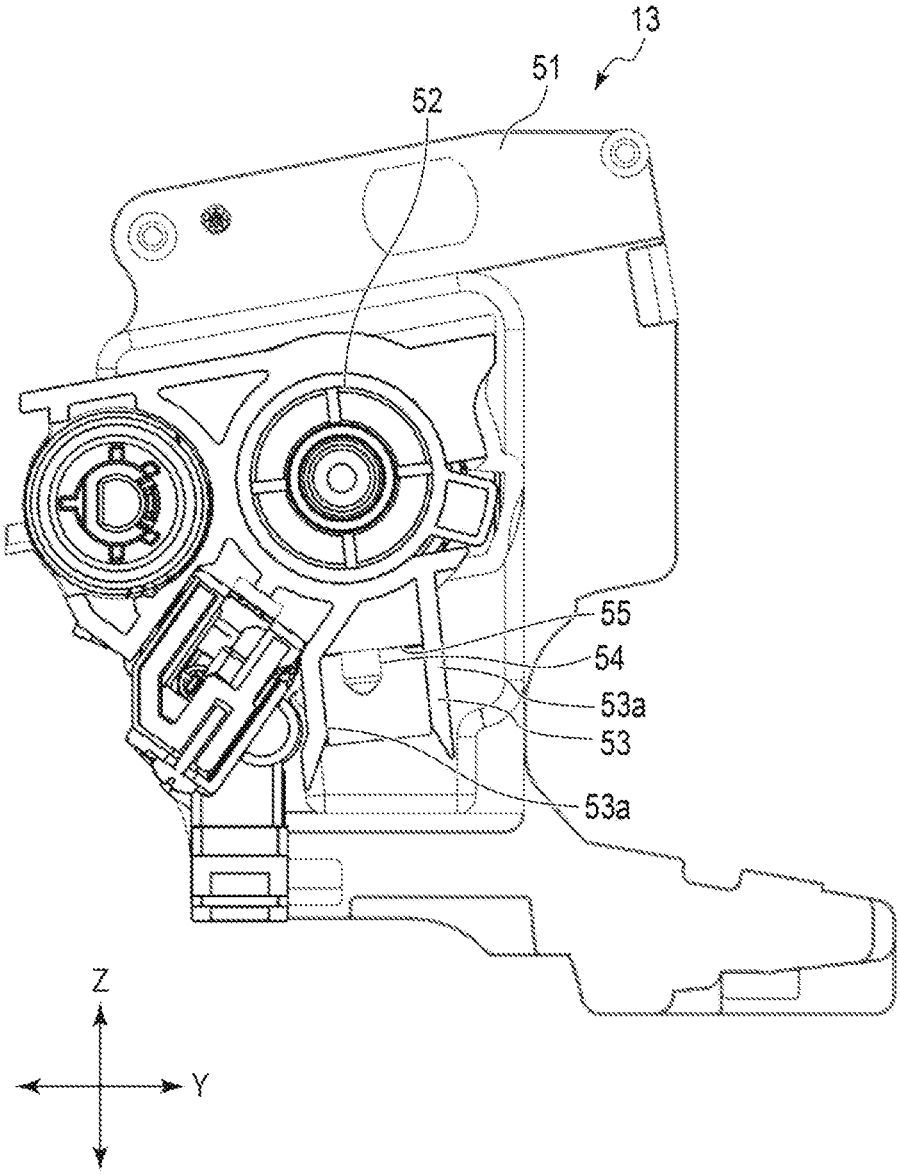
FIG. 21 is a perspective view illustrating a drum case of the image forming unit of the image forming apparatus according to the embodiment.
Figure 22:
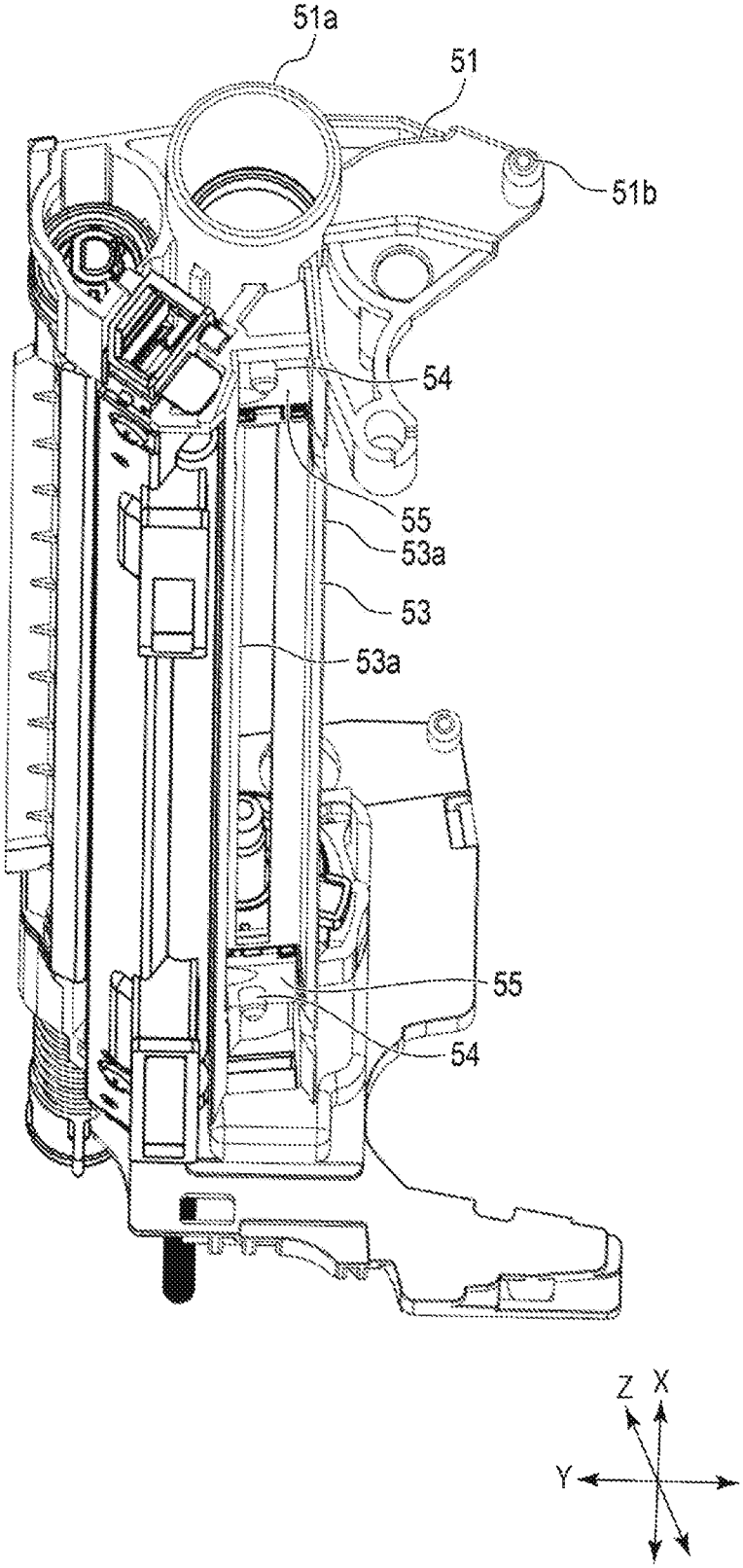
FIG. 22 is a perspective view illustrating the drum case of the image forming unit of the image forming apparatus according to the embodiment.

FIG. 21 is a sectional view illustrating the image forming unit 13. FIG. 22 is a perspective view illustrating a drum case 51 of the image forming unit 13.

The image forming apparatus 1 is, for example, a multi-function peripheral (MFP) device that integrates functions such as copying, scanning, and printers. As illustrated in FIGS. 1 and 2, the image forming apparatus 1 includes the frame 11, a plurality of solid head units 12, and a plurality of image forming units 13. The image forming apparatus 1 includes, for example, a paper feeding tray 14, a scanner unit 15, a transfer belt 16, a fixing device 17, a paper discharging tray 18, a transport device, and a control unit.

The number of solid head units 12 and image forming units 13 of the image forming apparatus 1 is set according to the type of developer used in the image forming apparatus 1. In the present embodiment, as an example, toners of four colors of yellow, magenta, cyan, and black are used as developers. As illustrated in FIGS. 1, 2, and 5, in the present embodiment, the image forming apparatus 1 includes four solid head units 12 and four image forming units 13.

As illustrated in FIGS. 1 to 4, the frame 11 supports each component of the image forming apparatus 1. A decorative plate (not illustrated) is provided on the outer surface side of the frame 11. That is, the image forming apparatus 1 has a decorative board on the outer surface side.

The frame 11 includes the front frame 21, the rear frame 22, and a plurality of connection frames 23. The front frame 21, the rear frame 22, and the plurality of connection frames 23 are formed of, for example, a stainless steel material and are electrically connected to each other. When any one of the front frame 21, the rear frame 22, and the plurality of connection frames 23 is grounded, the front frame 21, the rear frame 22, and the plurality of connection frames 23 of the frame 11 are grounded.

As illustrated in FIGS. 3 and 4, the front frame 21 and the rear frame 22 face each other in the X direction, which is the direction in which the image forming unit 13 of the image forming apparatus 1 is inserted. The front frame 21 and the rear frame 22 are integrally fixed by a plurality of connection frames 23 that are separated from each other in the Y direction and extend in the X direction. Four solid head units 12 and four image forming units 13 are fixed to the front frame 21 and the rear frame 22.

The front frame 21 has an insertion port 21*a* into which the four image forming units 13 are inserted from the front frame 21 side toward the rear frame 22 along the X direction. The insertion port 21*a* is an opening formed in the front frame 21. The insertion port 21*a* has a shape in which the four image forming units 13 can be inserted with the ends of the four solid head units 12 exposed to the outside. The insertion port 21*a* exposes an operation lever 32*a* (described later) of the solid head unit 12 and the image forming unit 13 to the outside.

The rear frame 22 has a plurality of support holes 22*a* and a plurality of guide holes 22*b*. The number of support holes 22*a* and the number of guide holes 22*b* is the same as the number of the image forming units 13, and in the present embodiment, there are four each. Each support hole 22*a* and each guide hole 22*b* are formed in a region facing the insertion port 21*a* formed in the front frame 21 of the rear frame 22 in the X direction. The support hole 22*a* supports the tip side of the image forming unit 13 in the insertion direction of the image forming unit 13. The support hole 22*a* is a circular hole formed in the rear frame 22. The guide hole 22*b* guides a posture around one axis about the axis along the insertion direction of the image forming unit 13 supported by the support hole 22*a*. The guide hole 22*b* is a circular hole formed in the rear frame 22.

As illustrated in FIGS. 5 to 11, the solid head unit 12 includes the base 31, a lifting mechanism 32, the solid head 33, and a first guide 34. The solid head unit 12 is formed long in one direction. The solid head unit 12 is fixed to the frame 11 with the longitudinal direction along the X direction.

The base 31 has a plate shape whose longitudinal direction is along the X direction. The base 31 supports a part of the lifting mechanism 32.

The lifting mechanism 32 reciprocates the solid head 33 in one direction with respect to the base 31. Hereinafter, the reciprocation of the solid head 33 in one direction with respect to the base 31 will be described as moving up and down. As illustrated in FIGS. 6 to 11, the lifting mechanism 32 uses a Scott Russell link mechanism. The lifting mechanism 32 includes, for example, the operation lever 32*a*, a conversion mechanism 32*b*, a slider 32*c*, an urging member 32*d*, a support member 32*e*, and a link 32*f*.

When the operation lever 32*a* is operated, the operation lever 32*a* can rotate within a predetermined angle range around an axis in the X direction. As illustrated in FIGS. 6, 8, and 9, the operation lever 32*a* includes an operation portion 32*a*1 that is rotated by an operator and a shaft portion 32*a*2 in the operation portion 32*a*1.

When the operation portion 32*a*1 is operated, the conversion mechanism 32*b* rotates the shaft portion 32*a*2 around the axis in the X direction and moves the shaft portion 32*a*2 in the axial direction. In the posture in which the solid head unit 12 is fixed to the frame 11, the axial direction of the shaft portion 32*a*2 is along the X direction.

The slider 32*c* is supported by the base 31 so as to be movable in the X direction. The shaft portion 32*a*2 is fixed to one end side of the slider 32*c* in the X direction. The urging member 32*d* is connected to the other end side of the slider 32*c* in the X direction. The slider 32*c* operates the link 32*f* in the X direction when moved along the X direction. The slider 32*c* rotatably supports one end of the link 32*f*.

One end of the urging member 32*d* is supported by the base 31. The other end of the urging member 32*d* is supported by the slider 32*c*. The urging member 32*d* is a coil spring. The urging member 32*d* urges the slider 32*c* in one direction. The urging member 32*d* urges the slider 32*c* in the direction away from the operation lever 32*a* along the X direction.

One end of the support member 32*e* is rotatably supported by the base 31. The other end of the support member 32*e* rotatably supports a first shaft 32*f*1 (described later) of the link 32*f*. For example, there are two support members 32*e*.

The links 32*f* are spaced apart in the X direction at two locations of the lifting mechanism 32. As illustrated in FIGS. 6 and 8 to 10, the link 32*f* includes the first shaft 32*f*1 rotatably supported by the support member 32*e*, a link body 32*f*2 provided at an end of the first shaft 32*f*1 in the axial direction, and a pair of second shafts 32*f*3 provided at both ends of the link body 32*f*2.

The link body 32*f*2 is a plate-like or bar-like member that is long in one direction. The link body 32*f*2 has the first shaft 32*f*1 at the center in the longitudinal direction. Each of the link bodies 32*f*2 has the second shaft 32*f*3 at both ends in the longitudinal direction. The pair of second shafts 32*f*3 protrude from the main surfaces at both ends of the link body 32*f*2 in the same direction as the first shaft 32*f*1. As illustrated in FIGS. 9 and 10, the pair of second shafts 32*f*3 are rotatably supported by the long hole on the side surface of the slider 32*c* and the long hole on the side surface of the solid head 33, respectively.

In the link 32*f*, when the slider 32*c* moves in the X direction and one of the second shafts 32*f*3 supported by the slider 32*c* moves in the X direction, a force in the X direction is applied to the end of the link body 32*f*2 on the slider 32*c* side. The slider 32*c* moves only in the X direction, and the other second shaft 32*f*3 of the link body 32*f*2 is supported by the solid head 33. The first shaft 32*f*1 at the center of the link body 32*f*2 in the longitudinal direction presses the support member 32*e*. The support member 32*e* rotates with respect to the base 31 around one end of the support member 32*e*. At this time, the link body 32*f*2 rotates around the first shaft 32*f*1. The link body 32*f*2 changes in angle with respect to the X direction. The second shaft 32*f*3 supported by the solid head 33 moves up and down. Thus, in the link 32*f*, when the slider 32*c* moves in the X direction, the link body 32*f*2 and the support member 32*e* move, and the second shaft 32*f*3 on the solid head 33 side moves up and down. Therefore, the lifting mechanism 32 moves the solid head 33 up and down in the Z direction with respect to the base 31.

The solid head 33 is an exposure apparatus. The solid head 33 constitutes a light source for writing that forms an electrostatic latent image on the image forming unit 13. As illustrated in FIGS. 6 to 15, the solid head 33 includes the print head 41, a holder 42, and the urging member 43. The solid head 33 is raised and lowered with respect to the base 31 by the lifting mechanism 32. When the solid head 33 is raised with respect to the base 31 and is positioned at a predetermined position with respect to the image forming unit 13, a part of the print head 41 or the holder 42 is in contact with a part of the image forming unit 13.

The print head 41 has a shape that is long in one direction. The print head 41 is, for example, an LED print head that uses an LED that emits light as a light source. The print head 41 is disposed in a predetermined positional relationship in the axial direction of the photoconductive drum 52 and the radial direction of the photoconductive drum 52 with respect to the photoconductive drum 52 (described later) of the image forming unit 13 when the image forming unit 13 is exposed. As illustrated in FIGS. 8 to 10, 14 and 15, the print head 41 has guide openings 41*a* formed at both ends in the longitudinal direction and at the tip of the solid head 33 in the ascending direction. The print head 41 has contact surfaces 41*b* that are in contact with a part of the image forming unit 13, for example, at both ends where the openings 41*a* are formed. The opening 41*a* is a circular or elliptical hole formed in the contact surface 41*b*.

The holder 42 supports both ends of the print head 41 in the longitudinal direction. As illustrated in FIGS. 6 and 8, the holder 42 supports the lower surface side of the print head 41 opposite to the side facing the photoconductive drum 52 in the ascending/descending direction of the solid head 33.

The urging member 43 is located between the lower surface of the print head 41 opposite to the side facing the photoconductive drum 52 and the holder 42. That is, the urging member 43 is located between the print head 41 and the holder 42 in the ascending/descending direction of the print head 41. The urging member 43 urges the print head 41 in a direction away from the holder 42 toward the photoconductive drum 52 side. A plurality of urging members 43 are provided. As illustrated in FIGS. 6 and 8, the urging member 43 is provided at two positions on both ends of the print head 41 in the longitudinal direction. The urging member 43 has a coil spring. The urging member 43 is formed of an electrically conductive metal material such as a stainless-steel material. The urging member 43 is electrically connected to an electrically conductive part such as a substrate of the print head 41. If the holder 42 has conductivity, it is also preferable that the print head 41 is electrically connected to the urging member 43 via the holder 42.

As illustrated in FIG. 16, the urging member 43 is integrally formed with the arm 45 extending from the lower end of the urging member 43 in the X direction. That is, the arm 45 is integrally formed of the same material as the urging member 43. The arm 45 has a spring property that bends in the ascending/descending direction. The arm 45 includes an arm main body 45*a* extending from the lower end of the urging member 43, and a wound portion (contact) 45*b* that is formed integrally with the arm body 45*a* and wound around the distal end separated from the urging member 43 in the XY plane.

The arm 45 of one urging member 43 protrudes toward the front frame 21 with respect to the holder 42. The arm 45 of the other urging member 43 protrudes toward the rear frame 22 with respect to the holder 42. The two urging members 43 move together with the holder 42 as the lifting mechanism 32 moves the solid head 33 relative to the base 31 in the Z direction.

The first guide 34 illustrated in FIG. 5 is fixed to at least one of the frame 11 or the base 31. The first guide 34 guides the moving direction of the image forming unit 13 along the X direction when the image forming unit 13 is inserted from the insertion port 21*a* of the front frame 21 and when the image forming unit 13 moves on the solid head unit 12 in the X direction after being inserted from the insertion port 21*a*. The first guide 34 is, for example, a rail that guides the image forming unit 13 by making contact with a part of the image forming unit 13 when the image forming unit 13 is inserted from the insertion port 21*a*.

As illustrated in FIGS. 12 and 13, an electrically conductive contact (ground metal plate) 61 is fixed to the holder 42. As illustrated in FIGS. 14 and 15, an electrically conductive contact (ground metal plate) 62 is fixed to the base 31. The contacts 61 and 62 are made of, for example, a stainless-steel material.

As illustrated in FIGS. 13, 17, and 18, as an example, the contact 61 on the front frame 21 side directly contacts the front frame 21. For this reason, the contact 61 on the front frame 21 side is electrically connected to the front frame 21 and grounded.

The contact 61 on the front frame 21 side illustrated in FIG. 13 is formed by cutting and bending an electrically conductive metal plate. The contact 61 has a tab 61*a* extending on the lower side of the holder 42. The tab 61*a* contacts the front surface of the front frame 21 due to the spring property. In the contact 61, the shape of the contact portion with the wound portion 45*b* of the arm 45 of the urging member 43 is, as an example, formed in the same shape as a base portion 64, a bent portion 65, an inclined portion 66, and a contact portion 67, which will be described later, of the contact 62 illustrated in FIGS. 14 and 15.

As illustrated in FIG. 13, when the contact 61 contacts the front frame 21, as illustrated in FIG. 12, the contact 61 is not visible when the solid head unit 12 is placed at a predetermined position.

When the solid head 33 is pulled out from the frame 11, the contact 61 moves from the front frame 21 to the front side. For this reason, when the solid head 33 is pulled out from the frame 11, it is possible to prevent the contact 61 from being loaded.

As illustrated in FIGS. 14 and 15, the contact 62 on the rear frame 22 side is formed by cutting and bending an electrically conductive metal plate. The contact 62 has abase portion 63 that is fixed to the base 31 with a screw 63*a*. The contact 62 includes an extension portion 64 extending upward along the Z axis from the base portion 63, the bent portion 65 bent in the Y-axis direction from the extension portion 64, the inclined portion 66 that intersects the XY plane from the bent portion 65 and faces upward in the Z direction, and the contact portion 67 at the distal end of the inclined portion 66 and bent downward in the Z direction with respect to the inclined portion 66. The wound portion 45*b* of the arm 45 is disposed below the Z direction near the boundary between the inclined portion 66 and the contact portion 67. The bent portion 65 is elastically deformed by receiving the gravity of the contact portion 67 and the inclined portion 66 and the force from the wound portion 45*b* of the arm 45.

As illustrated in FIGS. 19 and 20, the contact 62 indirectly contacts the rear frame 22. For example, the contact 62 on the rear frame 22 side electrically contacts the rear frame 22 via an electrically conductive paper-feeding side coil spring 14*a* of the paper feeding tray 14 and/or an electrically conductive paper-discharging side coil spring 18*a* of the paper discharge tray 18. For this reason, the contact 62 on the rear frame 22 side is electrically connected to the rear frame 22 indirectly and grounded.

The base portion 63 of the contact 62 is electrically connected to the electrically conductive paper-feeding side coil spring 14*a* via the contact 62 itself or an electrically conductive intermediate such as a conducting wire. The paper-feeding side coil spring 14*a* is located between the paper feeding tray 14 and the rear frame 22. The paper-feeding side coil spring 14*a* contacts the rear frame 22. For this reason, the contact 62 is indirectly electrically connected to the rear frame 22 via the conductive paper-feeding side coil spring 14*a*.

The base portion 63 of the contact 62 is electrically connected to the electrically conductive paper-discharging side coil spring 18*a* via the contact 62 itself or an electrically conductive intermediate such as a conducting wire. The paper-discharging side coil spring 18*a* is located between the paper discharging tray 18 and the rear frame 22. The paper-discharging side coil spring 18*a* contacts the rear frame 22. For this reason, the contact 62 is electrically connected to the rear frame 22 indirectly via the electrically conductive paper-discharging side coil spring 18*a*.

It is preferable that the contact 62 is electrically connected to both the paper-feeding side coil spring 14*a* and the paper-discharging side coil spring 18*a*. The contact 62 may be electrically connected to the paper-feeding side coil spring 14*a* or the paper-discharging side coil spring 18*a*. In addition, the contact 62 may be directly electrically connected to the rear frame 22. For this reason, the contact 62 is electrically connected to the frame 11 via one or a plurality of conductive members.

The image forming unit 13 is, for example, an electrophotographic process unit (EPU). In the present embodiment, for example, as illustrated in FIG. 2, an image forming unit 13A that stores a yellow toner, an image forming unit 13B that stores a magenta toner, an image forming unit 13C that stores a cyan toner, and an image forming unit 13D that stores a black toner are sequentially disposed from the primary side to the secondary side in the transport direction of sheets.

As illustrated in FIGS. 6 to 11, 21, and 22, the image forming unit 13 includes the drum case 51, the photoconductive drum 52, a second guide 53, a protrusion 54, and a contact surface 55. The image forming unit 13 includes, for example, a developing roller, a charging unit, a toner tank, and a cleaner case.

The drum case 51 supports the photoconductive drum 52 in a rotatable manner. As illustrated in FIGS. 4 and 22, the drum case 51 includes a supported portion 51*a* that is inserted into the support hole 22*a* of the rear frame 22, and a guide portion 51*b* that is inserted into the guide hole 22*b* of the rear frame 22 at one end in the longitudinal direction. The drum case 51 contacts the pair of rails 34*a* of the first guide 34 when the image forming unit 13 is inserted from the insertion port 21*a*, and guides the movement of the image forming unit 13 in the X direction.

The supported portion 51*a* is formed in a cylindrical shape, for example. The outer diameter of the supported portion 51*a* is set to be slightly smaller than the inner diameter of the support hole 22*a*.

The guide portion 51*b* is formed in a columnar shape, for example. The outer diameter of the guide portion 51*b* is set to be slightly smaller than the inner diameter of the guide hole 22*b*, for example. The guide portion 51*b* is inserted into the guide hole 22*b*, thereby guiding the posture of the drum case 51 in the rotation direction about the central axis of the supported portion 51*a* of the drum case 51.

The photoconductive drum 52 can form a uniform charge on the surface and is formed so that an electrostatic latent image can be formed on the surface when the surface is exposed. The photoconductive drum 52 is formed so that the toner attached to the electrostatic latent image can be transferred to paper.

The second guide 53 is formed integrally with the drum case 51, for example. For example, the second guide 53 is formed integrally with the drum case 51 or assembled integrally with the drum case 51.

When the image forming unit 13 is inserted into the insertion port 21*a*, if the second guide 53 contacts the solid head 33, the second guide 53 guides the position in the direction orthogonal to the insertion direction of the image forming unit 13 and the ascending direction of the solid head 33 with respect to the image forming unit 13 of the solid head 33. When the solid head 33 of the solid head unit 12 rises toward the photoconductive drum 52, the second guide 53 guides the movement of the solid head 33 so that the solid head 33 is in a predetermined position with respect to the photoconductive drum 52.

For example, the second guide 53 makes contact with the holder 42 of the solid head 33 to guide the solid head 33 to rise. As a specific example, the second guide 53 has a pair of plate-like portions 53*a* extending in a direction along the axial direction of the photoconductive drum 52. In the pair of plate-like portions 53*a*, the width on the photoconductive drum 52 side is set to a uniform width that is the same as the width of the solid head 33 in the direction orthogonal to the longitudinal direction and the ascending direction or slightly large enough to guide the solid head 33 to a predetermined position of the photoconductive drum 52. In the pair of plate-like portions 53*a*, the width of the tip portion gradually decreases from the tip toward the photoconductive drum 52 side. As a specific example, the tip portions of the pair of plate-like portions 53*a* are flat surfaces inclined with respect to the ascending direction of the solid head 33 so that the width gradually decreases from the tip toward the photoconductive drum 52 side, or formed by curved surfaces whose tangent lines are inclined with respect to the ascending direction. Here, the width of the pair of plate-like portions 53*a* is the width of a gap formed between the opposing surfaces of the pair of plate-like portions 53*a*.

That is, as illustrated in FIG. 21, the width of the pair of plate-like portions 53*a* is a gap larger than the width of the solid head 33 in the direction orthogonal to the longitudinal direction and the ascending direction up to the midway portion, from the tip toward the photoconductive drum 52 side, and is gradually decreased and is set to a uniform width substantially the same as the width of the solid head 33 from the midway portion.

As illustrated in FIG. 11, when the image forming unit 13 is inserted through the insertion port 21*a*, the tips of the pair of plate-like portions 53*a* overlap at least the tip of the holder 42 of the solid head 33 in the direction orthogonal to the longitudinal direction and the ascending/descending direction of the solid head 33. In other words, when the image forming unit 13 is inserted through the insertion port 21*a*, the tips of the pair of plate-like portions 53*a* are opposed to at least the tip of the holder 42 of the solid head 33 that is descending toward the base 31 side in the ascending direction of the solid head 33, in a direction orthogonal to the longitudinal direction and the ascending direction of the solid head 33.

The protrusion 54 is a so-called dowel. The protrusion 54 is a protrusion provided on the drum case 51, for example. The protrusion 54 is formed in a columnar shape, for example. The protrusions 54 are adjacent to both ends of the second guide 53 in the axial direction of the photoconductive drum 52. The protrusion 54 is inserted into the opening 41*a* provided in the print head 41. The protrusion 54 is inserted into the opening 41*a*, thereby positioning the longitudinal position of the photoconductive drum 52 supported by the drum case 51 with respect to the solid head 33. The protrusion 54 is inserted into the opening 41*a*, thereby restricting the movement of the drum case 51 in the X direction and fixing the image forming unit 13 to the frame 11 and the solid head unit 12.

The contact surface 55 supports the protrusion 54. The contact surface 55 contacts the contact surface 41*b* of the print head 41 in a state where the protrusion 54 is inserted into the opening 41*a*. Therefore, when the print head 41 contacts the image forming unit 13 and is in a predetermined position with respect to the image forming unit 13, the contact surfaces 41*b* and 55 contact.

The developing roller supplies toner from the toner tank to the surface of the photoconductive drum 52. The charging unit forms a uniform charge on the surface of the photoconductive drum 52. The toner tank stores toner. The cleaner case collects excess toner when the toner adheres to the photoconductive drum 52.

The paper feeding tray 14 stores sheets such as paper and film for printing and transports the sheets to a transport device. The paper feeding tray 14 is disposed below the frame 11, for example, below the plurality of solid head units 12 and the plurality of image forming units 13. The paper feeding tray 14 includes a pickup roller and takes out a corresponding sheet according to image forming processing. The taken paper sheet is transported to the image forming unit 13 and the transfer belt 16 by a transport device or the like.

The scanner unit 15 reads a placed document or the like. The scanner unit 15 includes, for example, a manual feeding tray 15*a*.

The transfer belt 16 transfers the toner attached to the electrostatic latent image on the photoconductive drum 52 onto a paper sheet passing through the photoconductive drum 52. The fixing device 17 fixes the toner on the paper sheet onto which the toner has been transferred.

The paper discharging tray 18 receives the discharged paper sheet on which the toner is fixed. The transport device transports the paper sheet from the paper feeding tray 14 to the paper discharging tray 18. For example, the transport device includes a plurality of rollers provided in the frame 11 and a driving device that rotates the rollers. In FIGS. 1 and 2, the paper discharging tray 18 is illustrated without a decorative board.

The control unit controls each component and performs image forming processing. The image forming processing, for example, includes charging processing for controlling the charging unit to form a uniform charge on the photoconductive drum 52 of the image forming unit 13, exposure processing for forming an electrostatic latent image by controlling the solid head unit 12 on the photoconductive drum 52, a development process for attaching toner to the electrostatic latent image on the photoconductive drum 52, transfer processing for transferring the toner attached to the electrostatic latent image to the sheet passing through the photoconductive drum 52 by the transfer belt 16 or the like, and fixing processing for fixing the toner on the sheet to which the toner has been transferred by the fixing device 17.

Next, the ground connection state of the print head 41 when performing image formation with the image forming apparatus 1 configured as described above and when performing maintenance on the image forming apparatus 1 will be described. Here, one urging member 43 is assumed to be close to the front frame 21. The other urging member 43 is assumed to be close to the rear frame 22.

In a state where the vertical positions of the base 31 and the image forming unit 13 are fixed, the solid head 33 between the base 31 and the image forming unit 13 is moved up and down by the lifting mechanism 32 within a predetermined movable range. The movable range of the lifting mechanism 32 is larger than the maximum distance between the print head 41 and the image forming unit 13.

When image formation is performed by the image forming apparatus 1, as illustrated in FIGS. 6 and 7, the solid head 33 is in contact with a part of the image forming unit 13 and is in a predetermined position. At this time, the contact surfaces 41*b* at both ends of the print head 41 of the solid head 33 contact the contact surfaces 55 at both ends of the image forming unit 13. As illustrated in FIG. 14, the solid head 33 of the image forming apparatus 1 is in a position raised with respect to the base 31 by the lifting mechanism 32.

The urging member 43 presses the print head 41 toward the image forming unit 13. The urging member 43 adjusts the contact load between the print head 41 and a part of the image forming unit 13 while the print head 41 is in contact with a part of the image forming unit 13.

As illustrated in FIGS. 14 and 19, the arm 45 of the other urging member 43 protrudes from the other end of the holder 42 of the solid head 33 toward the rear frame 22 and contacts the contact 62 fixed to the base 31. The contact 62 is electrically connected to the rear frame 22 by the paper-feeding side coil spring 14*a* and/or the paper-discharging side coil spring 18*a*. In other words, the urging member 43 indirectly electrically connects the print head 41 that contacts the urging member 43 and the rear frame 22 that contacts the contact 62 via the paper-feeding side coil spring 14*a* and/or the paper-discharging side coil spring 18*a*. Accordingly, the print head 41 is grounded.

As illustrated in FIGS. 12 and 17, the arm 45 of one urging member 43 protrudes from one end of the holder 42 of the solid head 33 toward the front frame 21 and contacts the contact 61 fixed to the holder 42. The contact 61 is electrically connected to the front frame 21. That is, the urging member 43 electrically connects the print head 41 that contacts the urging member 43 and the front frame 21 that contacts the contact 61. Accordingly, the print head 41 is grounded.

When performing maintenance on the image forming apparatus 1, the solid head 33 is separated from the image forming unit 13. During maintenance of the image forming apparatus 1, the solid head 33 is lowered with respect to the base 31 by the lifting mechanism 32. As illustrated in FIGS. 15, 18 and 20, when the solid head 33 of the image forming apparatus 1 is lowered with respect to the base 31 by the lifting mechanism 32, as illustrated in FIGS. 8 to 11, the solid head 33 is located away from the image forming unit 13.

As illustrated by an arrow Zd in FIG. 20, the arm 45 of the other urging member 43 of the solid head 33 descends as the holder 42 and the print head 41 descend. The arm 45 of the other urging member 43 releases the state in contact with the contact 62. That is, the other urging member 43 releases the electrical connection between the print head 41 that contacts the other urging member 43 and the rear frame 22 that indirectly contacts the contact 62. Therefore, the other urging member 43 releases the state in which the print head 41 is grounded.

At this time, in particular, as illustrated in FIG. 15, the wound portion 45*b* of the arm 45 of the other urging member 43 does not contact any component of the image forming apparatus 1 and floats. Therefore, when the solid head 33 is lowered with respect to the base 31 by the lifting mechanism 32 and the ground connection to the print head 41 is released, the load is prevented from being applied to the wound portion 45*b* of the arm 45 of the other urging member 43.

As illustrated by the arrow Zd in FIG. 18, the arm 45 of the other urging member 43 of the solid head 33 descends as the holder 42 and the print head 41 descend. The arm 45 of one urging member 43 releases the state in contact with the contact 61. That is, one urging member 43 releases the electrical connection between the print head 41 that contacts the one urging member 43 and the front frame 21 that contacts the contact 61. Accordingly, one urging member 43 releases the state in which the print head 41 is grounded.

At this time, in particular, the wound portion 45*b* of the arm 45 of one urging member 43 does not contact any component of the image forming apparatus 1 and floats like the wound portion 45*b* of the arm 45 of the other urging member 43. Therefore, when the solid head 33 is lowered with respect to the base 31 by the lifting mechanism 32 and the ground connection to the print head 41 is released, the load is prevented from being applied to the wound portion 45*b* of the arm 45 of one urging member 43.

After the maintenance of the image forming apparatus 1, when the image forming apparatus 1 performs image formation, the lifting mechanism 32 raises the solid head 33 relative to the base 31. When the solid head 33 is raised with respect to the base 31 by the lifting mechanism 32 from the state illustrated in FIGS. 8 and 15 to the state illustrated in FIGS. 6 and 14, the solid head 33 contacts a part of the image forming unit 13.

As illustrated by an arrow Zu in FIG. 19, the arm 45 of the other urging member 43 of the solid head 33 rises from the state illustrated in FIG. 15 to the state illustrated in FIG. 14 as the holder 42 and the print head 41 rise. As illustrated in FIG. 14, the arm 45 of the other urging member 43 contacts the contact 62 while the print head 41 is raised toward the image forming unit 13 by the lifting mechanism 32. The arm 45 of the other urging member 43 contacts the contact 62 from below and urges the contact 62 upward. For this reason, the contact 62 having spring property is elastically deformed according to the contact force by the arm 45. When the print head 41 is further raised toward the image forming unit 13 by the lifting mechanism 32, the inclined portion 66 and the contact portion 67 of the contact 62 urge the wound portion 45*b* of the arm 45 downward due to the spring property. Therefore, when the print head 41 is further raised toward the image forming unit 13 by the lifting mechanism 32, the arm 45 is elastically deformed and the contact 62 is elastically deformed. When the arm 45 is raised, the inclination angle of the inclined portion 66 of the contact 62 changes according to the position of the arm 45. For this reason, the wound portion 45*b* of the arm 45 and the contact 62 are in contact with each other in a state where the forces are balanced.

The vertical movement range of the arm 45 of the other urging member 43 and the contact position between the arm 45 of the other urging member 43 and the contact 62 on the rear frame 22 side change up and down within a range of allowed variation for each machine. Due to the spring property of the contact 62 on the rear frame 22 side, the contact 62 secures the amount of biting in the upward direction in the Z direction when the arm 45 of the other urging member 43 contacts the contact 62 by the overstrike. Therefore, the print head 41 is electrically connected to the rear frame 22 even if the contact position between the contact 62 on the rear frame 22 side and the arm 45 of the other urging member 43 varies. Due to the spring property of the arm 45 of the other urging member 43, the arm 45 of the other urging member 43 secures the amount of upward movement in the Z direction when the contact 62 on the rear frame 22 side contacts the arm 45 by the overstrike. Therefore, the print head 41 is electrically connected to the rear frame 22 even if the contact position between the contact 62 on the rear frame 22 side and the arm 45 of the other urging member 43 varies. Therefore, when the image forming apparatus 1 according to the present embodiment raises the solid head 33 with respect to the base 31 by the lifting mechanism 32, the print head 41 is securely grounded.

As described above, the shape of the contact portion of the contact 61 with the wound portion 45*b* of the arm 45 of the urging member 43 is the same as that of the base 64, the bent portion 65, the inclined portion 66, and the contact portion 67 of the contact 62 illustrated in FIGS. 14 and 15. Therefore, the print head 41 is electrically connected to the front frame 21 even if the contact position between the contact 61 on the front frame 21 side and the arm 45 of one urging member 43 varies. Therefore, when the image forming apparatus 1 according to the present embodiment raises the solid head 33 with respect to the base 31 by the lifting mechanism 32, the print head 41 is securely grounded.

In this manner, the arm 45 of the other urging member 43 contacts the contact 62 when the contact surface 41*b* of the print head 41 is in a contact position where the contact surface 41*b* of the print head 41 contacts the contact surface 55 of the image forming unit 13. The arm 45 of the other urging member 43 is separated from the contact 62 and is not in contact with the contact surface 41*b* of the print head 41 when the contact surface 41*b* is separated from the contact surface 55 of the image forming unit 13. When the arm 45 of the other urging member 43 is separated from the contact 62, the arm 45 does not contact any position and floats. For this reason, it is possible to prevent a load from being applied to the arm 45 of the other urging member 43 when the print head 41 is in the separated position away from the image forming unit 13.

Similarly, the arm 45 of one urging member 43 contacts the contact 61 when the contact surface 41*b* of the print head 41 is in a contact position where the contact surface 41*b* of the print head 41 contacts the contact surface 55 of the image forming unit 13. The arm 45 of one urging member 43 is separated from the contact 61 and is not in contact with the contact surface 41*b* of the print head 41 when the contact surface 41*b* is separated from the contact surface 55 of the image forming unit 13. When the arm 45 of one urging member 43 is separated from the contact 61, the arm 45 does not contact any position and floats. For this reason, it is possible to prevent a load from being applied to the arm 45 of one urging member 43 when the print head 41 is in the separated position away from the image forming unit 13.

According to the image forming apparatus 1 according to the embodiment, when the print head 41 that performs image formation in the image forming apparatus 1 is energized, the print head 41 can be securely connected to the ground via a component that electrically connects the print head 41 and the frame 11. According to the image forming apparatus 1 according to the embodiment, when the print head 41 that performs maintenance on the image forming apparatus 1 is de-energized, a component that electrically connects the print head 41 and the frame 11 can float to prevent a load from being generated on the component.

The embodiment is not limited to the examples described above. For example, in the above-described example, as a configuration for moving the solid head 33 up and down relative to the image forming unit 13, the configuration using the slider 32*c* that moves linearly by the rotation of the operation lever 32*a* and the link 32*f* that rotates by the movement of the slider 32*c* to raise and lower the solid head 33 has been described, but the present invention is not limited thereto.

In the example described above, the configuration in which the image forming unit 13 is disposed above the solid head unit 12 has been described, but the present invention is not limited thereto. For example, the image forming unit 13 may be disposed below the solid head unit 12.

Although an example in which the print head 41 of the solid head 33 has the opening 41*a* and the protrusion 54 inserted into the opening 41*a* is in the drum case 51 has been described, the present invention is not limited thereto. For example, the opening 41*a* may be in the holder 42 of the solid head 33. The opening 41*a* may be in the image forming unit 13 and the protrusion 54 may be in the solid head 33.

While certain embodiments have been described, these embodiments have been presented by way of example only, and are not intended to limit the scope of the inventions. Indeed, the novel embodiment described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus, comprising:

an electrically conductive and grounded frame;

an image forming unit;

a print head;

a holder that supports the print head;

an electrically conductive urging member between the print head and the holder and urges the print head toward the image forming unit; and an electrically conductive arm that extends from the urging member and is electrically connected to the urging member, wherein the arm floats when the print head is separated from the image forming unit, and the arm is electrically connected to the frame when the print head contacts the image forming unit.

2. The apparatus according to claim 1, further comprising:

a base fixed to the frame, wherein the base has a contact that is electrically connected to the frame.

3. The apparatus according to claim 2,
wherein the contact has a spring property and is elastically deformed according to a contact force by the arm when the print head contacts the image forming unit.

4. The apparatus according to claim 2,
wherein the contact is electrically connected directly to the frame.

5. The apparatus according to claim 2,
wherein the contact is electrically connected to the frame via one or more conductive members.

6. The apparatus according to claim 1,
wherein the frame includes an electrically conductive and grounded front frame, and an electrically conductive and grounded rear frame that faces the front frame, and
the arm is electrically connected to at least one of the front frame and the rear frame when the print head contacts the image forming unit.

7. The apparatus according to claim 1, further comprising:
a plurality of image forming units;
a plurality of print heads;
a plurality of holders, each of the plurality of holders correspondingly support each of the plurality of print heads;
a plurality of electrically conductive urging members correspondingly between the plurality of print heads and the plurality of holders; and
a plurality of electrically conductive arms, each of the plurality of electrically conductive arms correspondingly connected to each of the plurality of urging members.

8. The apparatus according to claim 1, further comprising:
four image forming units;
four print heads;
four holders, each of the holders correspondingly support each of the print heads;
four electrically conductive urging members correspondingly between the four print heads and the four holders; and
four electrically conductive arms, each of the four electrically conductive arms correspondingly connected to each of the four urging members.

9. The apparatus according to claim 1,
wherein the urging member is a coiled spring.

10. A multifunctional peripheral, comprising:
an electrically conductive and grounded frame;
an image forming unit;
a print head;
a holder that supports the print head;
an electrically conductive urging member between the print head and the holder and urges the print head toward the image forming unit; and
an electrically conductive arm that extends from the urging member and is electrically connected to the urging member,
wherein the arm floats when the print head is separated from the image forming unit, and the arm is electrically connected to the frame when the print head contacts the image forming unit.

11. The multifunctional peripheral according to claim 10, further comprising:
a base fixed to the frame,
wherein the base has a contact that is electrically connected to the frame.

12. The multifunctional peripheral according to claim 11,
wherein the contact has a spring property and is elastically deformed according to a contact force by the arm when the print head contacts the image forming unit.

13. The multifunctional peripheral according to claim 11,
wherein the contact is electrically connected directly to the frame.

14. The multifunctional peripheral according to claim 11,
wherein the contact is electrically connected to the frame via one or more conductive members.

15. The multifunctional peripheral according to claim 10,
wherein the frame includes an electrically conductive and grounded front frame, and an electrically conductive and grounded rear frame that faces the front frame, and
the arm is electrically connected to at least one of the front frame and the rear frame when the print head contacts the image forming unit.

16. The multifunctional peripheral according to claim 10, further comprising:
a plurality of image forming units;
a plurality of print heads;
a plurality of holders, each of the plurality of holders correspondingly support each of the plurality of print heads;
a plurality of electrically conductive urging members correspondingly between the plurality of print heads and the plurality of holders; and
a plurality of electrically conductive arms, each of the plurality of electrically conductive arms correspondingly connected to each of the plurality of urging members.

17. The multifunctional peripheral according to claim 10, further comprising:
four image forming units;
four print heads;
four holders, each of the holders correspondingly support each of the print heads;
four electrically conductive urging members correspondingly between the four print heads and the four holders; and
four electrically conductive arms, each of the four electrically conductive arms correspondingly connected to each of the four urging members.

18. The multifunctional peripheral according to claim 10,
wherein the urging member is a coiled spring.

19. A method of an image forming apparatus, comprising:
floating an electrically conductive arm connected to an electrically conductive urging member between a print head and a holder that supports the print head when separating the print head from an image forming unit;
cleaning the print head; and
after cleaning, electrically connecting the arm to an electrically conductive and grounded frame when contacting the print head with the image forming unit.

20. The method according to claim 19, further comprising:
forming an image on a medium after contacting the print head with the image forming unit.

* * * * *